US007124890B2

(12) United States Patent
McLeod et al.

(10) Patent No.: US 7,124,890 B2
(45) Date of Patent: Oct. 24, 2006

(54) CASE READY STACKABLE TRAY DESIGNS

(75) Inventors: Michael B. McLeod, Romeoville, IL (US); Karl M. Ritter, Geneva, IL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 111 days.

(21) Appl. No.: 10/082,642

(22) Filed: Feb. 25, 2002

(65) Prior Publication Data

US 2003/0159964 A1 Aug. 28, 2003

(51) Int. Cl.
*B65D 21/00* (2006.01)

(52) U.S. Cl. ..... 206/509; 206/597; 229/915; 229/919

(58) Field of Classification Search ..... 206/508, 206/509, 511, 597, 512; 229/915, 918, 919, 229/165, 174, 191
See application file for complete search history.

(56) References Cited

U.S. PATENT DOCUMENTS

| | | | | |
|---|---|---|---|---|
| 2,703,764 | A * | 3/1955 | Vogt | 428/43 |
| 2,894,672 | A * | 7/1959 | Bamburg | 206/45.26 |
| 3,871,570 | A | 3/1975 | Garmon | |
| 4,373,659 | A * | 2/1983 | Cornell et al. | 206/511 |
| 4,868,955 | A * | 9/1989 | Magnant et al. | 24/306 |
| 4,905,834 | A | 3/1990 | Mur Gimeno et al. | 206/512 |
| 4,923,113 | A * | 5/1990 | Guijarro | 229/125.27 |
| 5,052,615 | A | 10/1991 | Ott et al. | 229/182 |
| 5,390,847 | A * | 2/1995 | Young | 229/125.29 |
| 5,429,296 | A | 7/1995 | Southwell et al. | 229/168 |
| 5,458,283 | A | 10/1995 | Southwell et al. | 229/178 |
| 5,649,663 | A * | 7/1997 | Pestow, Jr. | 229/190 |
| 5,673,848 | A | 10/1997 | Garza | 229/191 |
| H1748 | H * | 9/1998 | Marinelli et al. | 206/83.5 |
| 5,860,590 | A * | 1/1999 | Blomfield et al. | 229/165 |
| 6,050,419 | A * | 4/2000 | Flanagan et al. | 206/597 |
| 6,131,805 | A * | 10/2000 | Gasior | 229/174 |
| 6,227,779 | B1 * | 5/2001 | Bullock | 410/98 |
| 6,286,753 | B1 * | 9/2001 | Jackson et al. | 229/174 |
| 6,354,487 | B1 * | 3/2002 | Muise, Jr. | 229/125.28 |
| 6,375,068 | B1 * | 4/2002 | Jackson et al. | 229/174 |
| 6,460,758 | B1 | 10/2002 | Fenton et al. | 229/174 |
| 6,481,619 | B1 | 11/2002 | Jackson | 229/169 |
| 6,502,698 | B1 * | 1/2003 | McKenna et al. | 206/509 |
| 6,508,395 | B1 * | 1/2003 | McLeod | 229/174 |
| 6,604,675 | B1 * | 8/2003 | Southwell | 229/164 |
| 6,640,975 | B1 * | 11/2003 | Bennett et al. | 206/509 |

(Continued)

FOREIGN PATENT DOCUMENTS

AU A-61361/90 3/1991

(Continued)

OTHER PUBLICATIONS

Series of Photos of "In Line Automatic Container Stacker", Avon Products, Inc. Atlanta Distribution Center, device dates to at least as early as Feb. 24, 2001.

(Continued)

*Primary Examiner*—Shian T. Luong
(74) *Attorney, Agent, or Firm*—Armstrong Teasdale LLP

(57) ABSTRACT

A shipping system for packing and transporting products, such as case ready food items, in which the products require a certain amount of separation between layers. The shipping system comprises a shipping unit, formed by at least one substantially open-topped tray, preferably two or more, that are stacked atop one another, with a cover placed atop the uppermost tray, and held together by banding or strapping. Preferably, the tray(s) and cover are fabricated from corrugated paperboard material.

17 Claims, 37 Drawing Sheets

U.S. PATENT DOCUMENTS

| | | | | |
|---|---|---|---|---|
| 6,641,032 | B1 * | 11/2003 | Schilling | 229/174 |
| 2002/0125308 | A1 * | 9/2002 | McLeod | 229/174 |

FOREIGN PATENT DOCUMENTS

| | | | |
|---|---|---|---|
| AU | A-13040/92 | | 11/1992 |
| DE | 40 17 416 | A1 | 12/1990 |
| EP | 0 326 451 | B1 | 3/1993 |
| FR | 2 306 888 | | 11/1976 |
| GB | 2 043 596 | A | 10/1980 |
| GB | 2 086 352 | A | 5/1982 |
| GB | 2 194 776 | A | 3/1988 |

OTHER PUBLICATIONS

"The White Sheet", Board Converting News, Mar. 29, 1999, N.V. Publications, vol. 15, No. 13, pp. 1, 20, 22 and last page.

Presentation Brochure, "Corrugated Common Footprint for Product Packaging, Kroger, Sep. 13, 2000", by Fibre Box Association.

* cited by examiner

690

730

CASE READY STACKABLE TRAY DESIGNS

BACKGROUND OF THE INVENTION

1. Field of the Invention

The present invention is directed to trays that are used for the packing and shipping of products for sale, in particular products that are prepared, packed and shipped in a condition in which they can be transferred directly from the shipping tray to a display case ("case ready" food products). The present invention is directed in particular, to packing and shipping methods and structures, for facilitated handling of plural ones of such trays, which can be stacked and maintained in a stacked configuration during shipping.

2. Prior Art

Primary package trays, such as those constructed of molded plastic, molded foam, or paperboard, configured for the shipping of products, such as food products, in which the trays are configured to be stacked and maintained in a stacked configuration during shipping, are known. Such trays are used in the shipment of food products, such as case ready meat products, produce, etc.

Such products are in the prior art, shipped in corrugated package designs typically including an outer shipping container carton (e.g., "RSC", "Bliss", Die Cut Wrap or Lidded Tray configurations, as those are known as and referred to by those of skill in the art of food packing and shipping), and multiple pieces of inner packing, usually consisting of corrugated layer pads and "U"-pads (scored sheets, configured in a "U" shape and placed inside the shipper, one per shipper when used, with the legs in a downward direction so that it may serve as a shelf, dividing the amount of weight the layers of stacked trays must support). When the layers of product are added to the container, the separating layer pads and/or a shelf are used to displace the weight of the layers over a larger area, but this does not eliminate each of the lower layers from carrying some of the weight of the layers above. Because none of the inner packaging provides any real stacking support in a unitized (palletized) load format, this usually requires the outer box to be constructed of a heavy weight and costly corrugated substrate.

These and other desirable characteristics of the invention will become apparent in light of the present specification, including claims, and drawings.

SUMMARY OF THE INVENTION

The present invention is directed to a shipping system for the facilitated packing and transportation of items, wherein the items are of a type requiring separation between vertically stacked layers. The shipping system comprises at least one shipping unit. Each shipping unit further comprises at least one substantially open-topped shipping tray, wherein each shipping trays is operably configured to be stacked atop at least one other shipping tray; a cover, operably configured to be positioned atop the uppermost one of said at least one substantially open-topped shipping tray of the at least one shipping unit; and at least one binding member, operably configured to hold the cover atop the uppermost substantially open-topped shipping tray of the at least one shipping unit.

Each substantially open-topped shipping tray within said at least one shipping unit has a top plan configuration as each of said at least one other substantially open-topped shipping tray, and the cover has a top plan configuration substantially the same as each of said at least one substantially open-topped shipping tray.

In a preferred embodiment of the invention, at least one shipping tray is fabricated from corrugated paperboard material. Alternatively, at least one shipping tray may be fabricated from plastic material. In a preferred embodiment of the invention, at least one cover is fabricated from corrugated paperboard material. Alternatively, at least one cover may be fabricated from plastic material.

In an alternative embodiment of the invention, wherein the at least one shipping unit includes at least two trays, and at least one of the trays includes stacking tabs, and the other of the at least two trays includes apertures for receiving the stacking tabs of the other of the at least two trays.

In one alternative embodiment of the invention, the cover comprises a substantially planar pad. In such an embodiment, the pad may be configured to accommodate stacking tabs extending upwardly from an uppermost substantially open-topped tray of the shipping unit.

In an alternative embodiment of the invention, the cover has a shoe box type lid configuration. In such an embodiment, the shoe box type lid configuration may further be configured to accommodate stacking tabs extending upwardly from an uppermost substantially open-topped tray of the shipping unit.

In an alternative embodiment of the invention, the at least one binding member comprises at least one substantially thin, flat band encircling the at least one substantially open-topped tray and the cover. The at least one band may be fabricated from paper material. In an alternative embodiment of the invention, the at least one band is fabricated from plastic material. Alternatively, the at least one band may be a metal or plastic strap.

In a preferred embodiment of the invention, the shipping unit comprises at least two non-identical substantially open-topped trays, having substantially similar top plan configurations.

In an alternative embodiment of the invention, the at least one binding member comprises at least one strip of adhesive tape material, simultaneously engaging a top surface of the cover and a bottom surface of a bottom-most one of the at least one substantially-open-topped shipping tray.

DETAILED DESCRIPTION OF THE DRAWINGS

Figure 1:
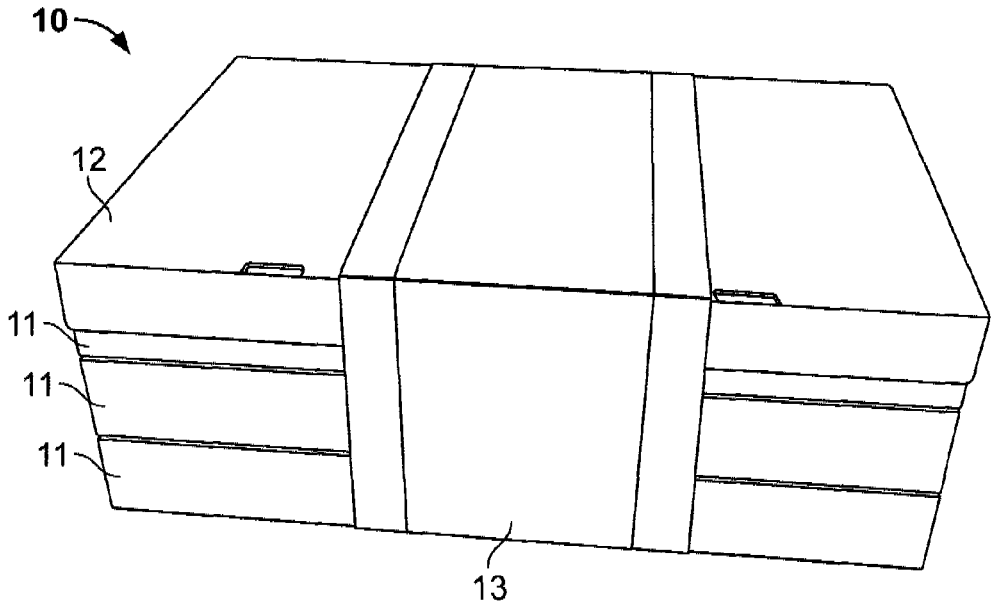
FIG. 1 is a perspective view of a shipping unit according to an embodiment of the invention, incorporating packing trays with stacking tabs, a shoe box type-lid capable of accommodating stacking tabs, and a side band.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

Various blanks are illustrated herein, for the trays and covers for the shipping system according to the present invention. In the blank illustrations, unless otherwise indicated, the usual drawing conventions are applied, wherein solid lines on the interior of a blank, indicate an aperture or complete through cut, and broken lines indicate a line of weakness, such as a score, crease, perforation, or other means for weakening the blank, to permit breaking or folding.

Any dimensions, distances or other numerical values, that may be given in the description herein, or in the Figures, are given by way of example, and the present invention is not to be considered limited thereto.

In the present invention, the blanks for the trays and covers are preferably formed from corrugated paperboard, although other materials may be employed, such as paper or paperboard, as may be appropriate for the particular application. In addition, in alternative embodiments of the invention, the one or more of the trays in a shipping unit may be fabricated from a plastic material, such as corrugated plastic material.

In the present invention, the trays that may be used in the shipping units may be entirely open-topped trays, or may be trays having "shoulders" or other structures that partially extend across the upper opening of the trays. All such trays, whether completely or partially open-topped may be considered herein as "substantially open-topped trays".

FIG. 1 is a perspective view of a shipping unit 10 according to an embodiment of the invention, incorporating packing trays 11 with stacking tabs, a shoe box type-lid 12 capable of accommodating stacking tabs, and a side band 13. Trays 11 may be of the type represented by the blank of FIG. 14. Band 13 may be a paper material, such as Kraft paper.

Figure 2:
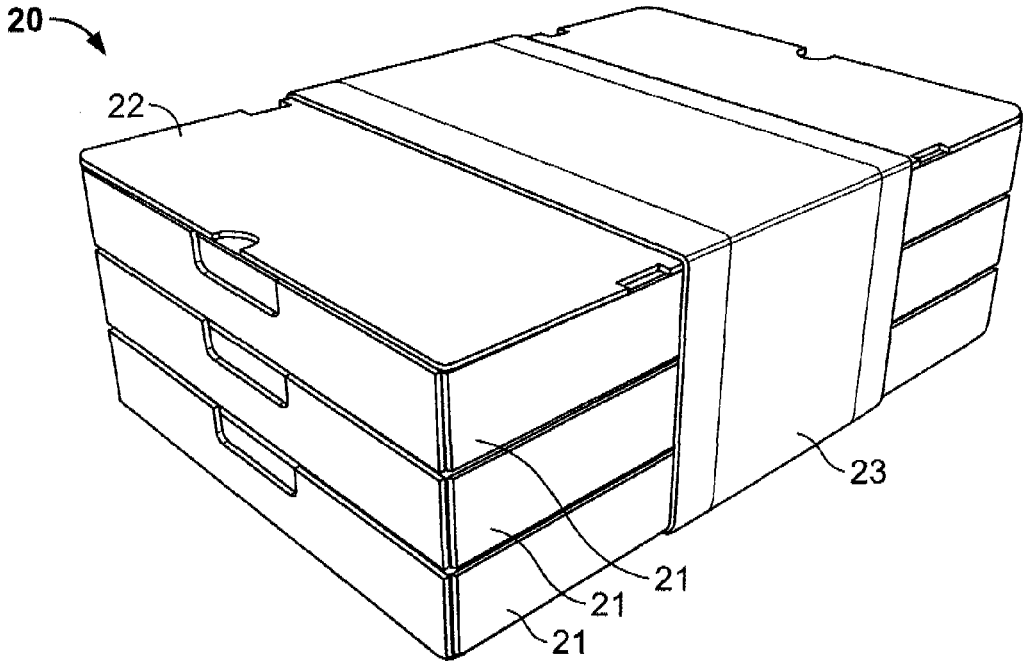
FIG. 2 is a perspective view of a shipping unit according to another embodiment of the invention, incorporating stacking trays (illustrated without stacking tabs), a die cut pad-type lid (capable of accommodating stacking tabs), and a side band.
Figure 21:
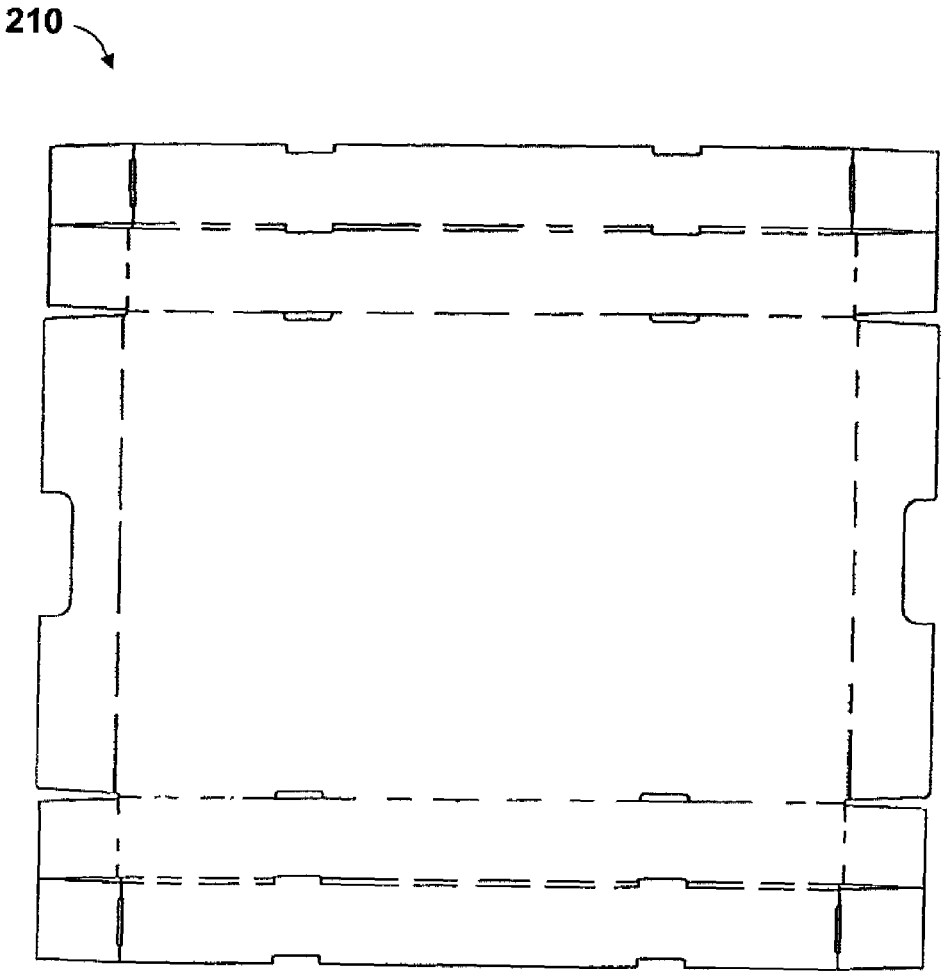
FIG. 21 is a plan view of a blank for a tray according to another embodiment of the invention.

FIG. 2 is a perspective view of a shipping unit 20 according to another embodiment of the invention, incorporating stacking trays 21 (illustrated without stacking tabs), a die cut pad-type lid 22 (capable of accommodating stacking tabs), and a side band 23. Trays 21 may be formed from blanks, as shown in FIG. 21. Band 23 may be a paper material, such as Kraft paper.

Figure 3:
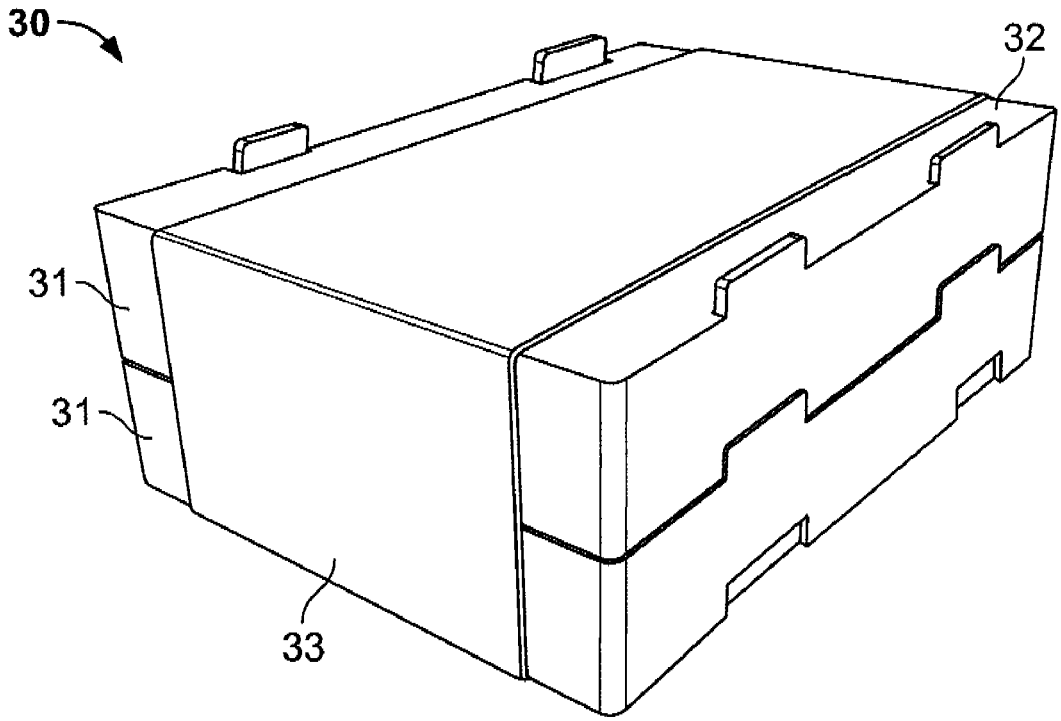
FIG. 3 is a perspective view of a shipping unit according to another alternative embodiment of the invention, incorporating trays with stacking tabs, a die cut pad-type lid (accommodating stacking tabs), and an end band.

FIG. 3 is a perspective view of a shipping unit 30 according to another alternative embodiment of the invention, incorporating trays 31 with stacking tabs, a die cut pad-type lid 32 (accommodating stacking tabs), and an end band 33. Trays 31 may be formed from blanks, as shown in FIG. 21. Band 33 may be fabricated of a paper material, such as Kraft paper.

Figure 4:
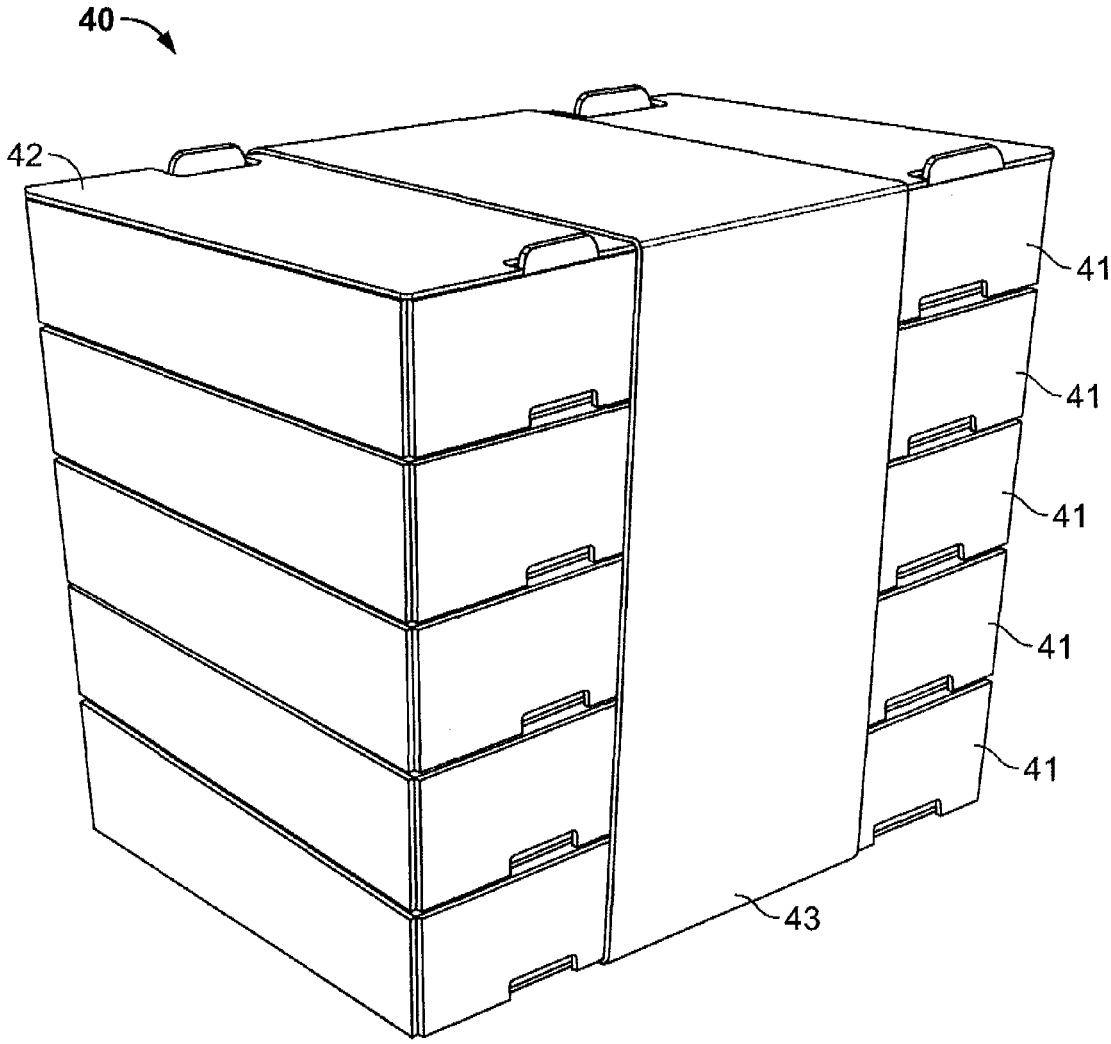
FIG. 4 is a perspective view of a shipping unit according to another alternative embodiment of the invention, incorporating trays with stacking tabs, a die cut pad-type lid (accommodating stacking tabs), and a side band.
Figure 30:
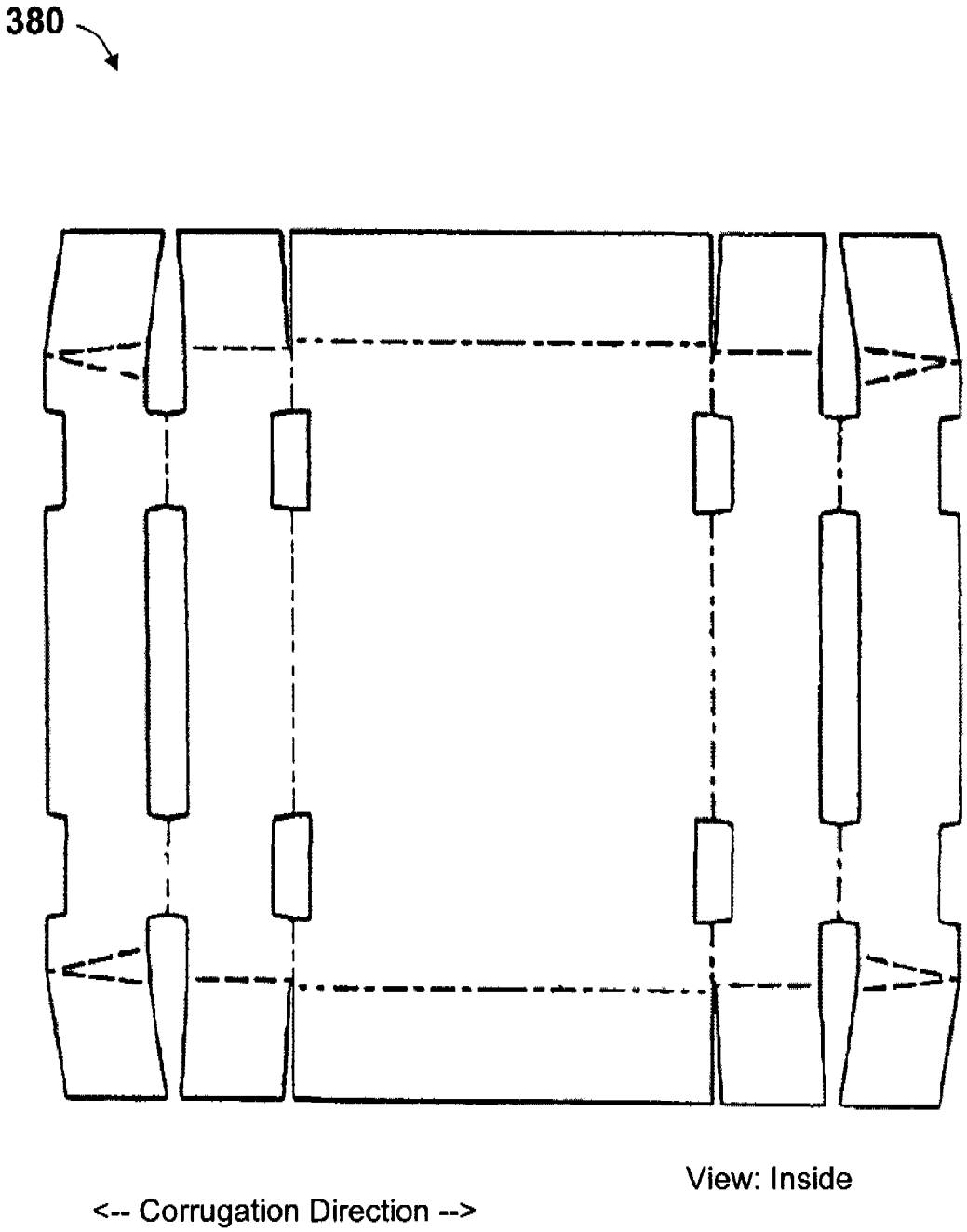
FIG. 30 illustrates a blank for a tray having double-wall length walls, and V-shaped corner gussets for an alternative embodiment of the invention.
Figure 31:
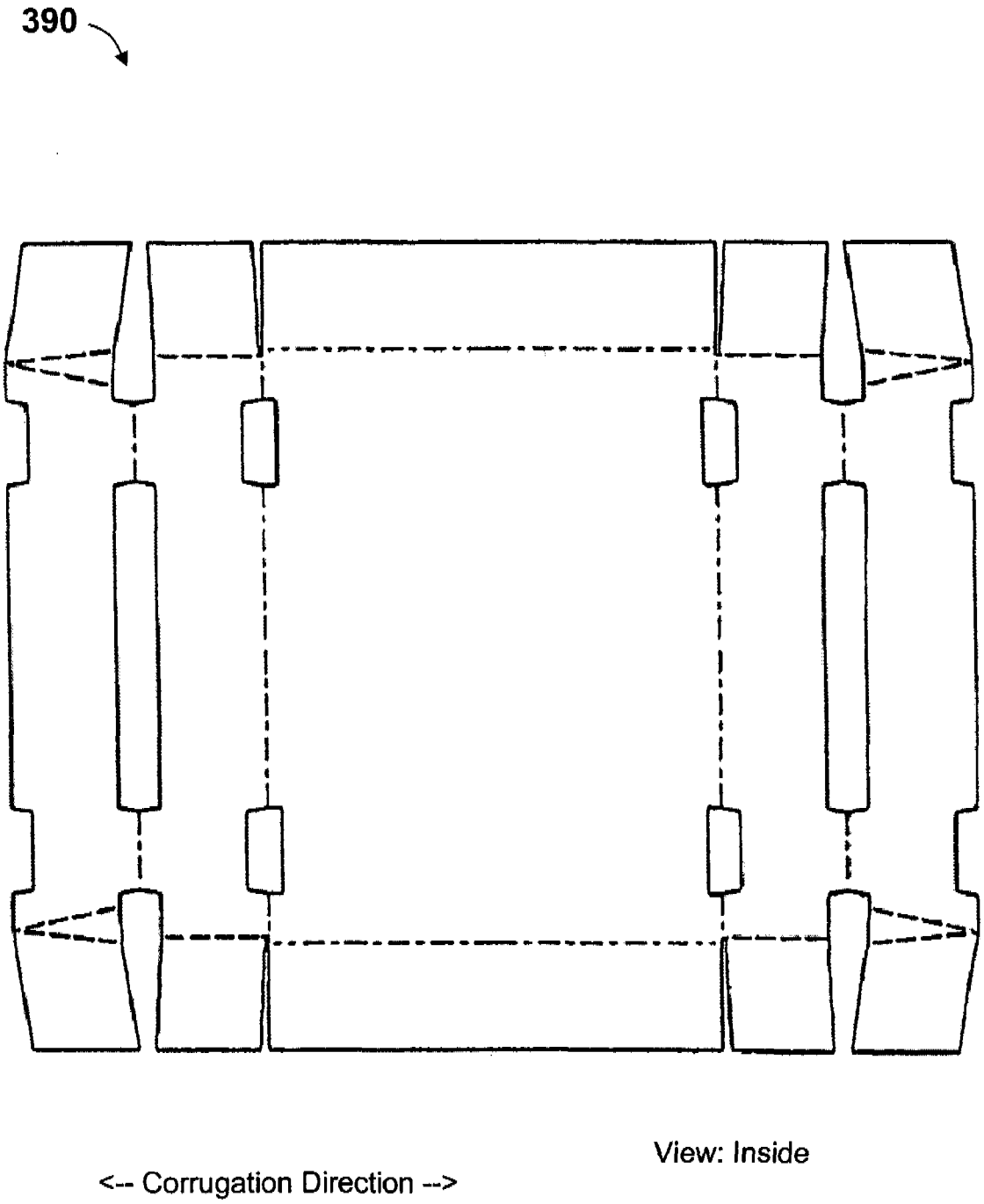
FIG. 31 illustrates a blank for a tray having double-wall length walls, and V-shaped corner gussets for an alternative embodiment of the invention.
Figure 32:
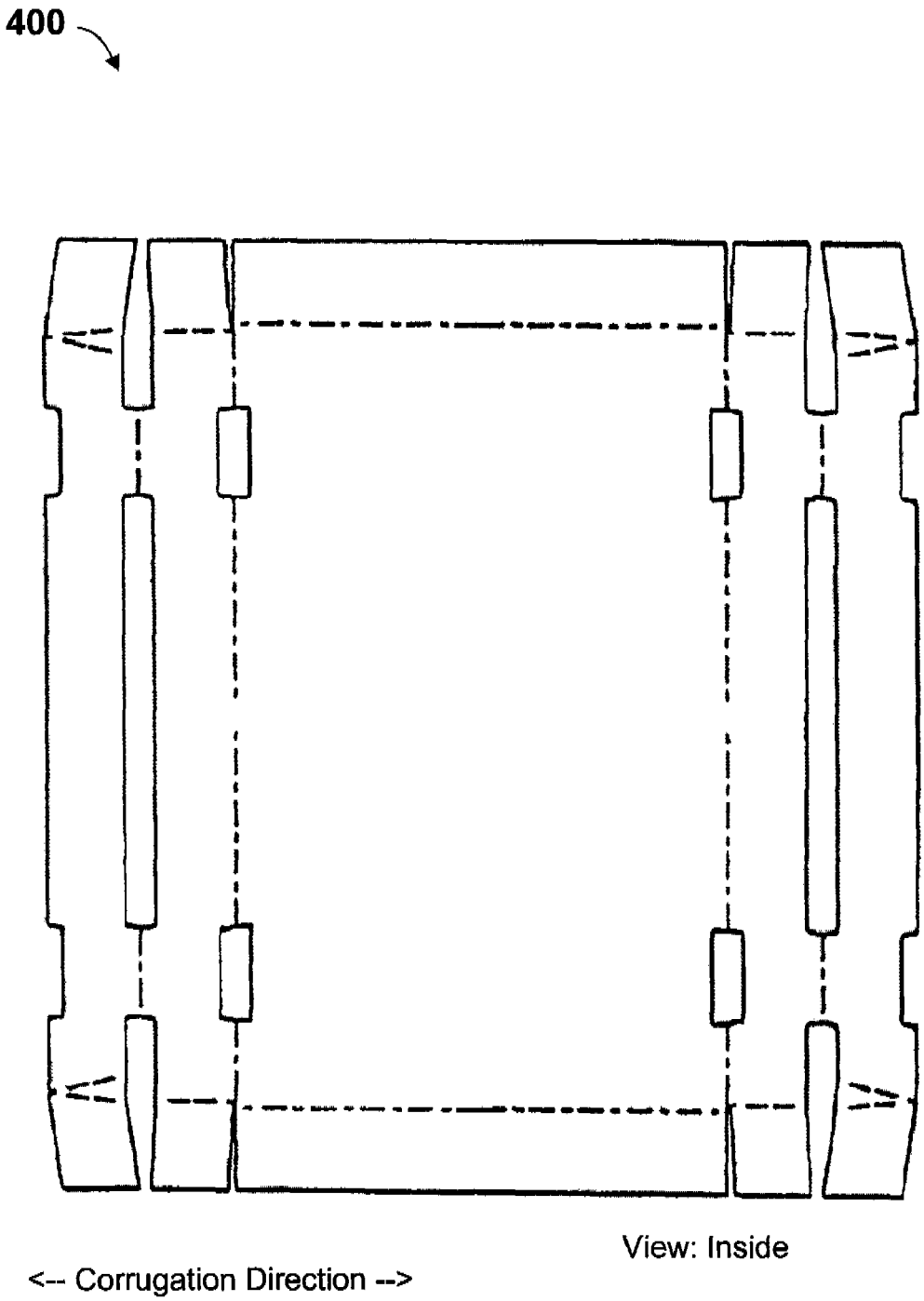
FIG. 32 illustrates a blank for a tray having double-wall length walls, and V-shaped corner gussets for an alternative embodiment of the invention.

FIG. 4 is a perspective view of a shipping unit 40 according to another alternative embodiment of the invention, incorporating trays 41 with stacking tabs, a die cut pad-type lid 42 (accommodating stacking tabs), and a side band 43. Trays 41 may be formed from blanks, as shown in FIGS. 30–32. FIG. 30 illustrates a blank 380 for a tray having double-wall length walls, and V-shaped corner gussets for an alternative embodiment of the invention. FIG. 31 illustrates a blank 390 for a tray having double-wall length walls, and V-shaped corner gussets for an alternative embodiment of the invention. FIG. 32 illustrates a blank 400 for a tray having double-wall length walls, and V-shaped corner gussets for an alternative embodiment of the invention.

Figure 5:
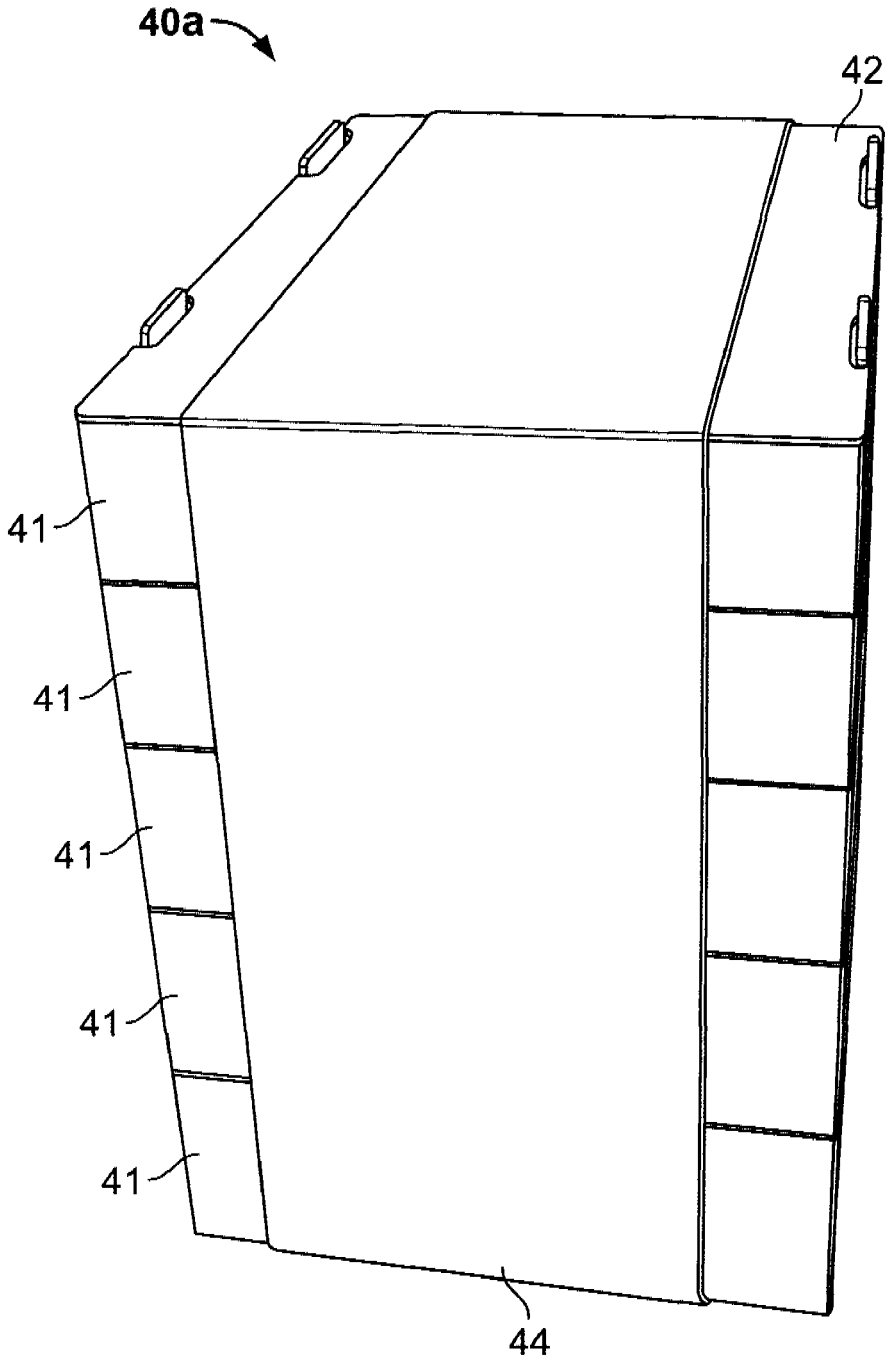
FIG. 5 is a perspective view of a shipping unit according to the embodiment of FIG. 4, incorporating trays with stacking tabs, a die cut pad-type lid (accommodating stacking tabs), and an end band.

FIG. 5 is a perspective view of a shipping unit 40*a* according to the embodiment of FIG. 4, incorporating trays 41 with stacking tabs, a die cut pad-type lid 42 (accommodating stacking tabs), and an end band 44. In accordance with the shipping system of the present invention, in all of the embodiments, each shipping unit may comprise one or a multiple number of trays, a single cover, and a binding device, such as a paper or plastic band, or metal strapping.

Figure 6:
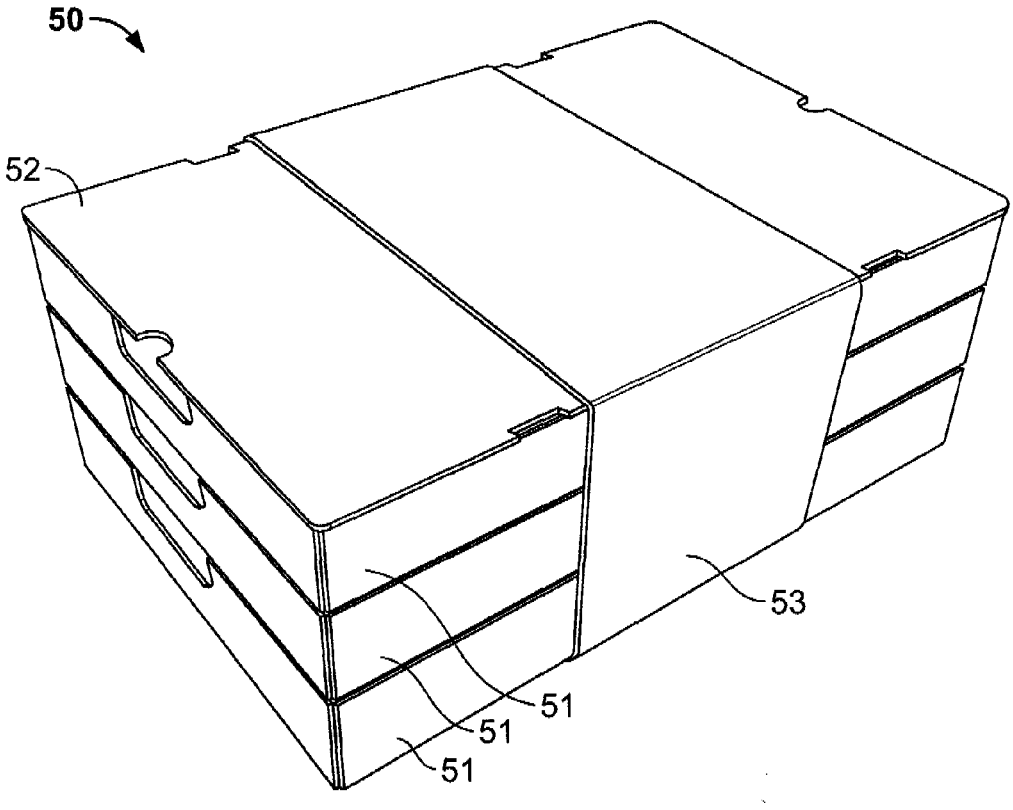
FIG. 6 is a perspective view of a shipping unit according to another alternative embodiment of the invention, incorporating trays without stacking tabs, a die cut pad-type lid (accommodating stacking tabs), and a side band.
Figure 7:
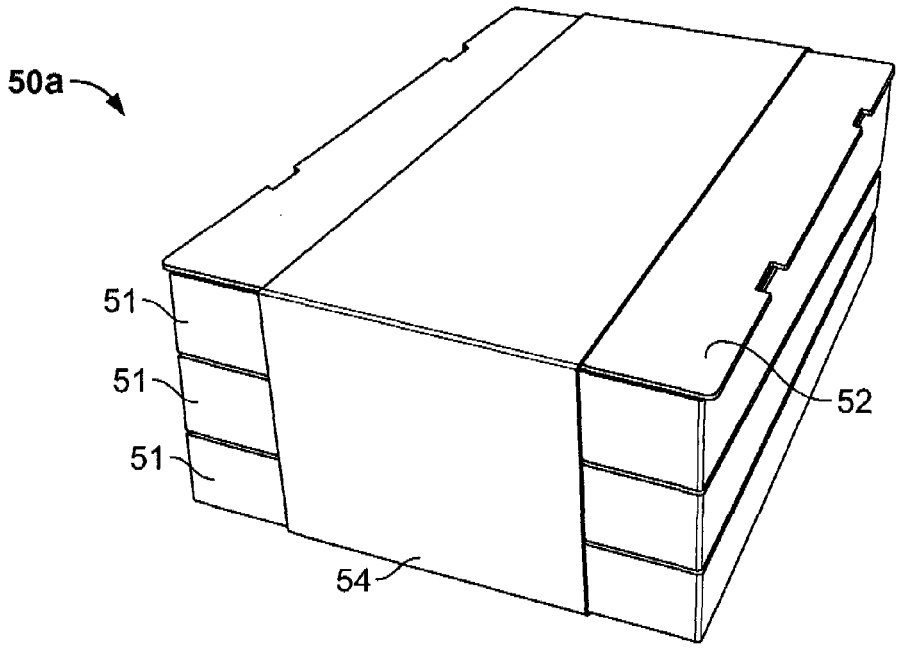
FIG. 7 is a perspective view of a shipping unit according to the embodiment of FIG. 6, incorporating trays without stacking tabs, a die cut pad-type lid (accommodating stacking tabs), and an end band.

FIG. 6 is a perspective view of a shipping unit 50 according to another alternative embodiment of the invention, incorporating trays 51 without stacking tabs, a die cut pad-type lid 52 (accommodating stacking tabs), and a side band 53. Trays 51 may be formed from blanks according to FIG. 21. FIG. 7 is a perspective view of a shipping unit 50*a* according to the embodiment of FIG. 6, incorporating trays 51 without stacking tabs, a die cut pad-type lid 52 (accommodating stacking tabs), and an end band 54. As applied to all of the contemplated embodiments, the bands, as described, may be of paper or plastic, and may be opaque (paper or plastic) or translucent or clear (plastic), and may be plain or printed, as desired. The width of the banding and/or number and spacing of the straps may be varied according to the anticipated loading.

Figure 8:
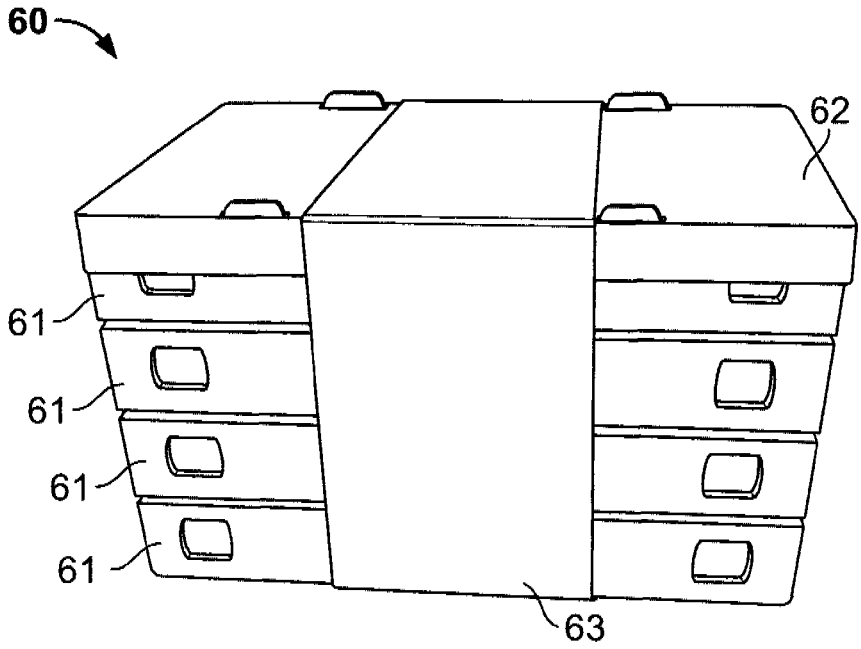
FIG. 8 is a perspective view of a shipping unit according to another alternative embodiment of the invention, incorporating trays having stacking tabs and side venting apertures, a shoe box type lid, and a side band.
Figure 9:
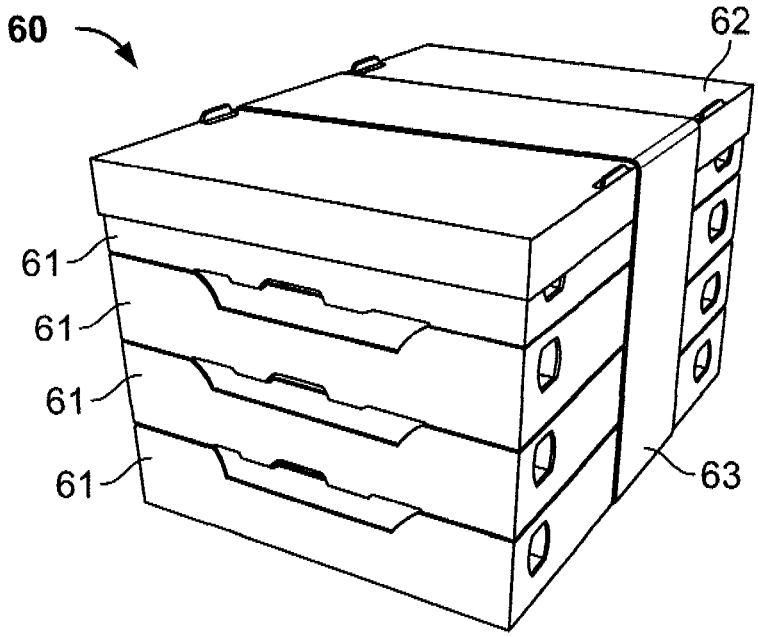
FIG. 9 is another perspective view of the shipping unit according to FIG. 8

FIG. 8 is a perspective view of a shipping unit 60 according to another alternative embodiment of the invention, incorporating trays 61 having stacking tabs and side venting apertures, a shoe box type lid 62, and a side band 63. FIG. 9 is another perspective view of the shipping unit according to FIG. 8. Trays 61 may be formed from blanks according to FIG. 19. To provide flexibility to the shipping system, the trays may have various configurations, as exemplified, but not limited by the various tray blanks indicated herein. The trays may have interior corner gussets (e.g. FIG. 13), stacking tabs and corresponding slots, or ventilation apertures (e.g. FIGS. 14, 15, 16, 19).

Figure 10:
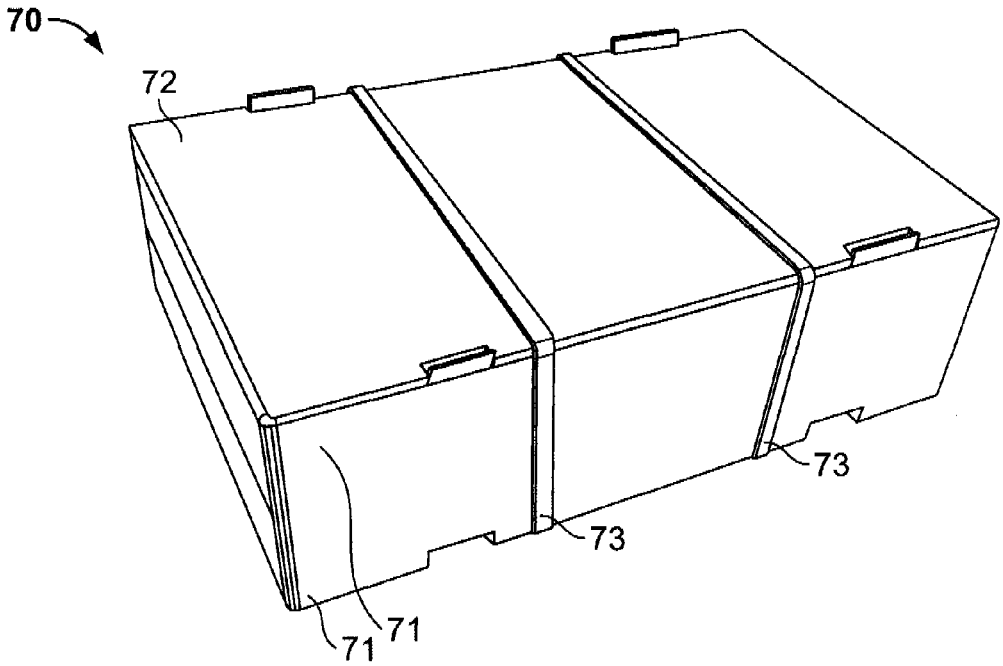
FIG. 10 is a perspective view of a shipping unit according to another alternative embodiment of the invention, including trays having stacking tabs, a die cut pad-type lid, and side strapping.
Figure 12:
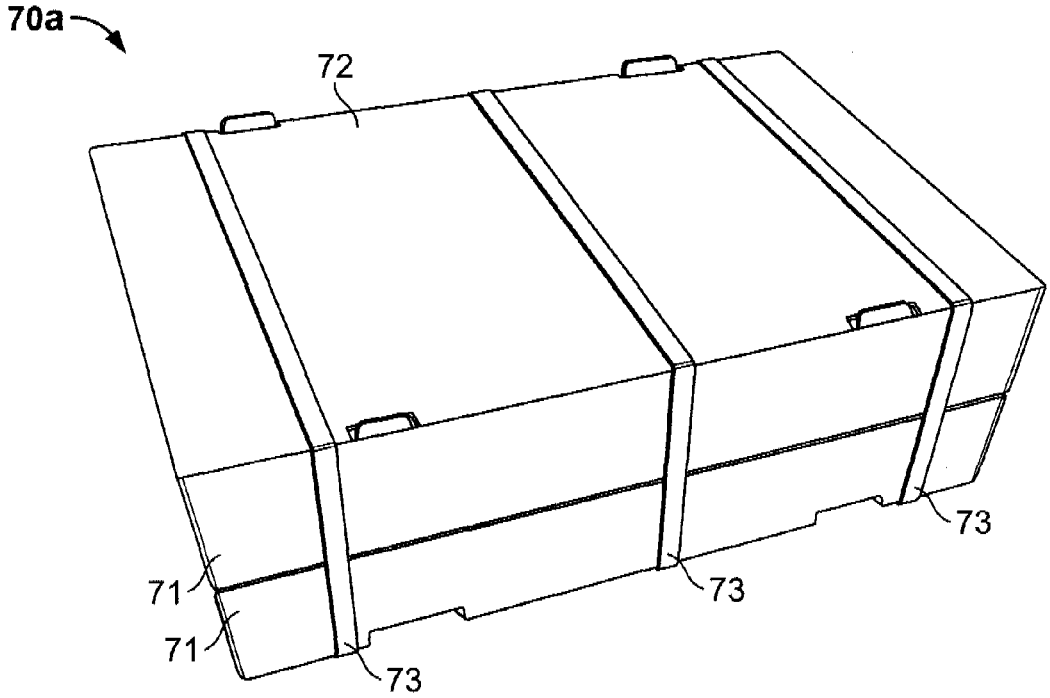
FIG. 12 is another perspective view of the shipping unit according to FIG. 10, having three side bands.
Figure 20:
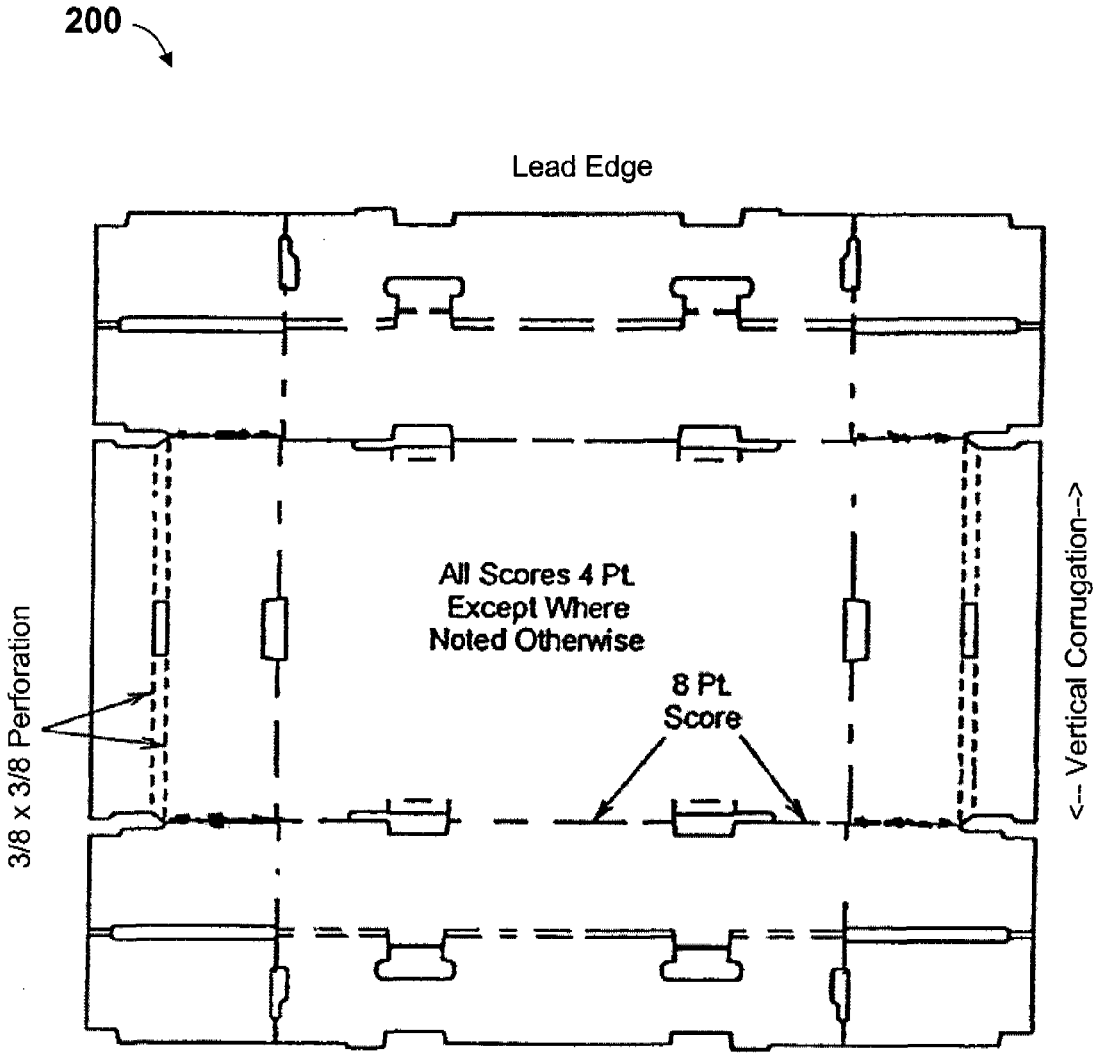
FIG. 20 is a plan view of a blank for a tray according to another embodiment of the invention.

FIG. 10 is a perspective view of a shipping unit 70 according to another alternative embodiment of the invention, including trays 71 having stacking tabs, a die cut pad-type lid 72, and side straps 73. FIG. 12 is another perspective view of a shipping unit 70*a* according to FIG. 10, having trays 71, pad-type lid 72 and three side straps 73. Trays 71 may be formed from blanks such as that shown in FIG. 20.

Figure 11:
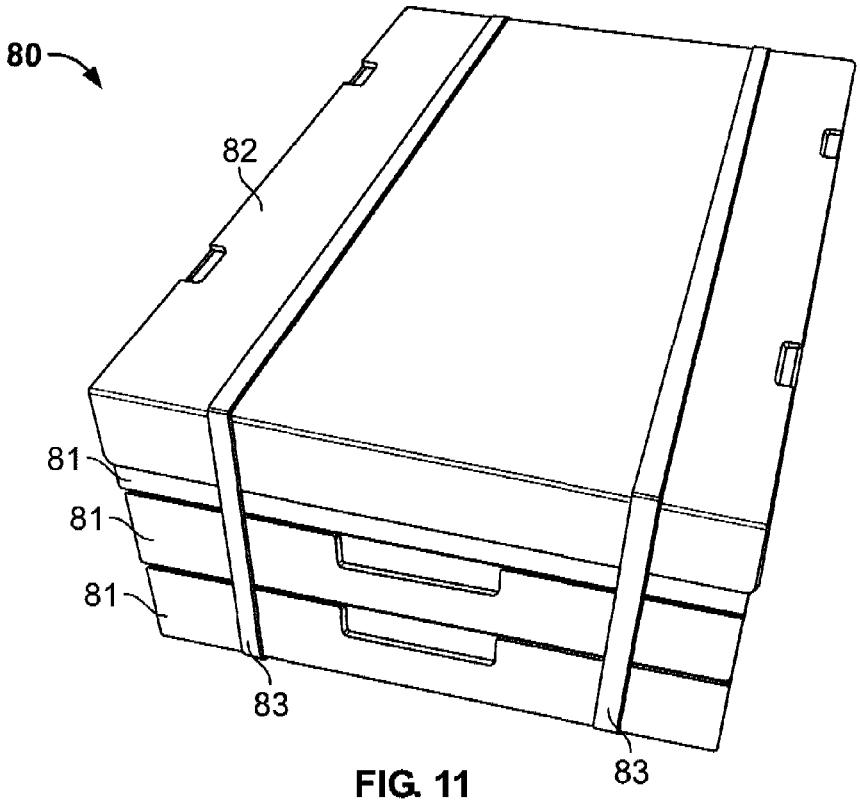
FIG. 11 is a perspective view of a shipping unit according to another alternative embodiment of the invention, incorporating trays without stacking tabs, a shoe box type lid, and end strapping.

FIG. 11 is a perspective view of a shipping unit 80 according to another alternative embodiment of the invention, incorporating trays 81 without stacking tabs, a shoe box type lid 82, and end straps 83. Trays 81 may be formed from blanks similar to that shown in FIG. 21.

Figure 26:
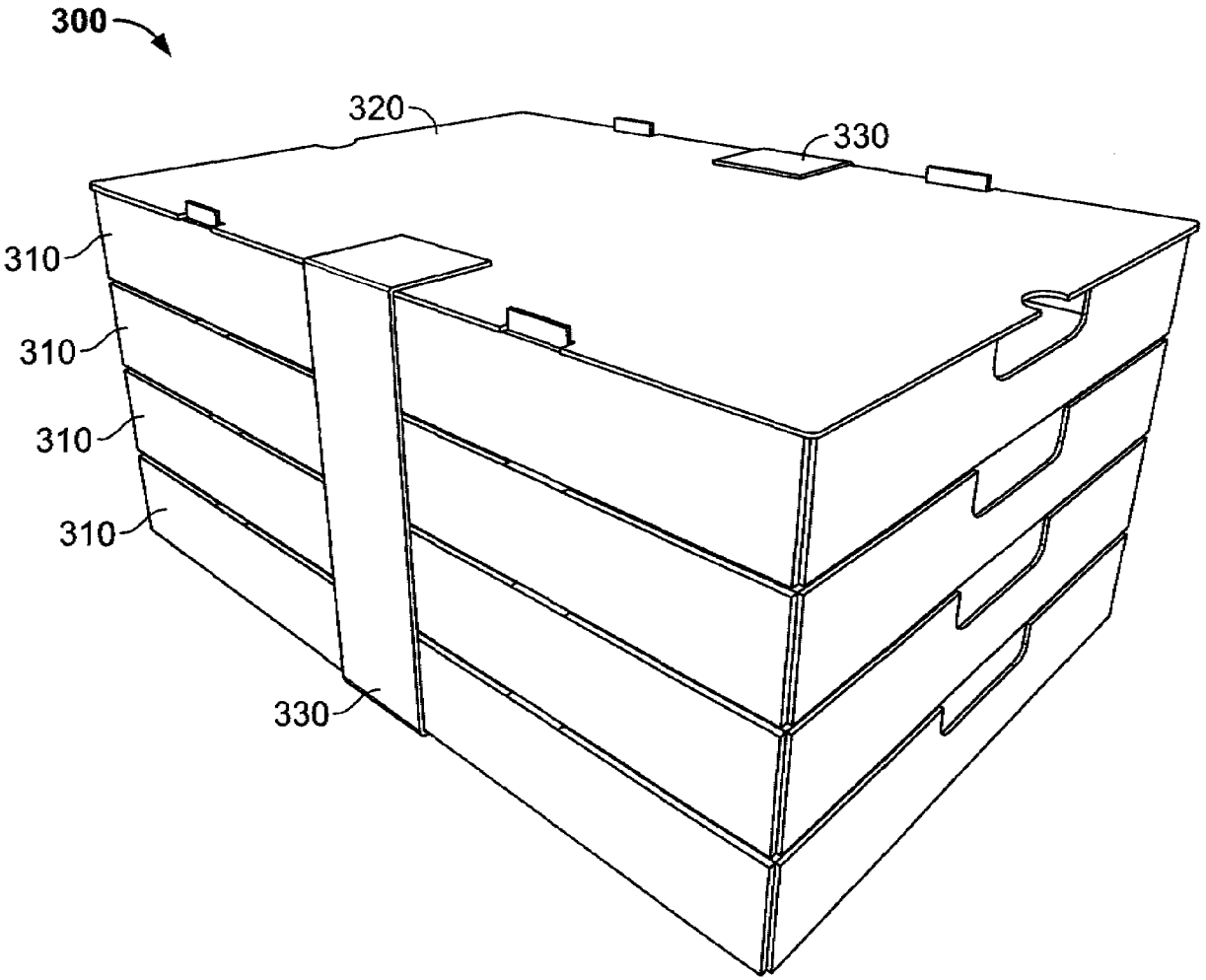
FIG. 26 is a perspective view of a shipping unit according to another alternative embodiment of the invention, in which pressure sensitive tape is used to hold a plurality of trays together.

FIG. 26 is a shipping unit 300, having trays 310 with stacking tabs, and a die cut cover 320. Two C-shaped strips 330 of pressure-sensitive tape, or other form of tape, are used to hold the trays and cover together. The bottom legs of the "C" are affixed to the bottom of the bottom-most tray. Alternative, instead of two strips, a single, inverted "U"-shaped strip of tape may be used, wherein the base of the U extends across the top of the cover, and two short "legs" of tape extend from the vertical legs of tape, to engage the bottom surface of the bottom-most tray.

FIGS. 13–21 are plan views of blanks for trays that may be used with the shipping unit system according to the invention. The blanks that are shown are all readily understood by those of ordinary skill in the art of corrugated shipping trays. By way of example, the manner of converting the blank shown in FIG. 13, into a tray, e.g., tray 21 of FIG. 2 is as follows.

Figure 13:
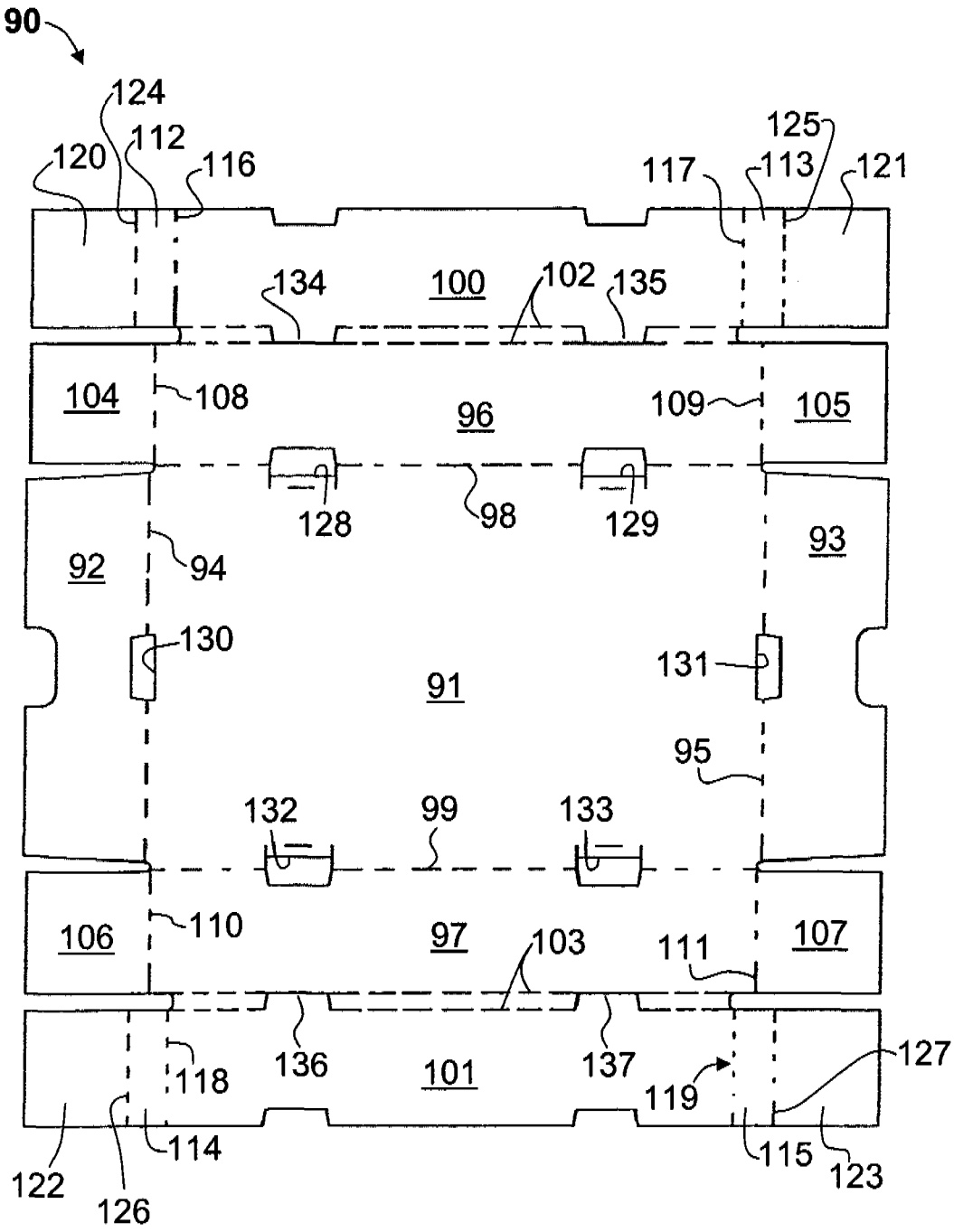
FIG. 13 is a plan view of a blank for a tray according to one embodiment of the invention.

Referring to FIG. 13, blank 90 includes bottom wall 91; end walls 92, 93 connected to bottom wall 91 by fold lines 94, 95; outer sidewalls 96, 97 connected to bottom wall 91 by fold lines 98, 99; inner sidewalls 100, 101 connected to outer sidewalls 96, 97 by fold line pairs 102, 103; first minor flaps 104, 105, 106, 107 connected to outer sidewalls 96, 97 by fold lines 108, 109, 110 and 111; gussets 112, 113, 114 and 115 connected to inner sidewalls 100, 101 by fold lines 116–119; and second minor flaps 120–123, connected to gussets 112–115 by fold lines 124–127. Blank 90 also includes apertures 128–133, and die cut stacking tabs 134–137.

To erect a tray 21 from blank 90, inner sidewalls 100, 101 are folded inward about fold lines pairs 102, 103, to overlie outer sidewalls 96, 97. Next, end walls 92, 93 are folded up about fold lines 94, 95 to be perpendicular to bottom wall 91. Outer sidewalls 96, 97 are then next folded up perpendicular to bottom wall 91. Depending upon the folding sequence, first minor flaps 104–107 may be positioned to the inside or the outside of end walls 92–93, and adhered thereto. Second minor flaps 120–123 may, depending upon the location of first minor flaps 104–107, be adhered to the insides of end walls 92–93 or alternatively, to the insides of first minor flaps 104–107. Gussets 112–115 will then be positioned perpendicular to bottom wall 91, and extend diagonally across the respective four corners of bottom wall 91. When stacked, the stacking tabs 134–137 will be received by the apertures 128 and 129, 132 and 133 of a like tray stacked above.

Figure 14:
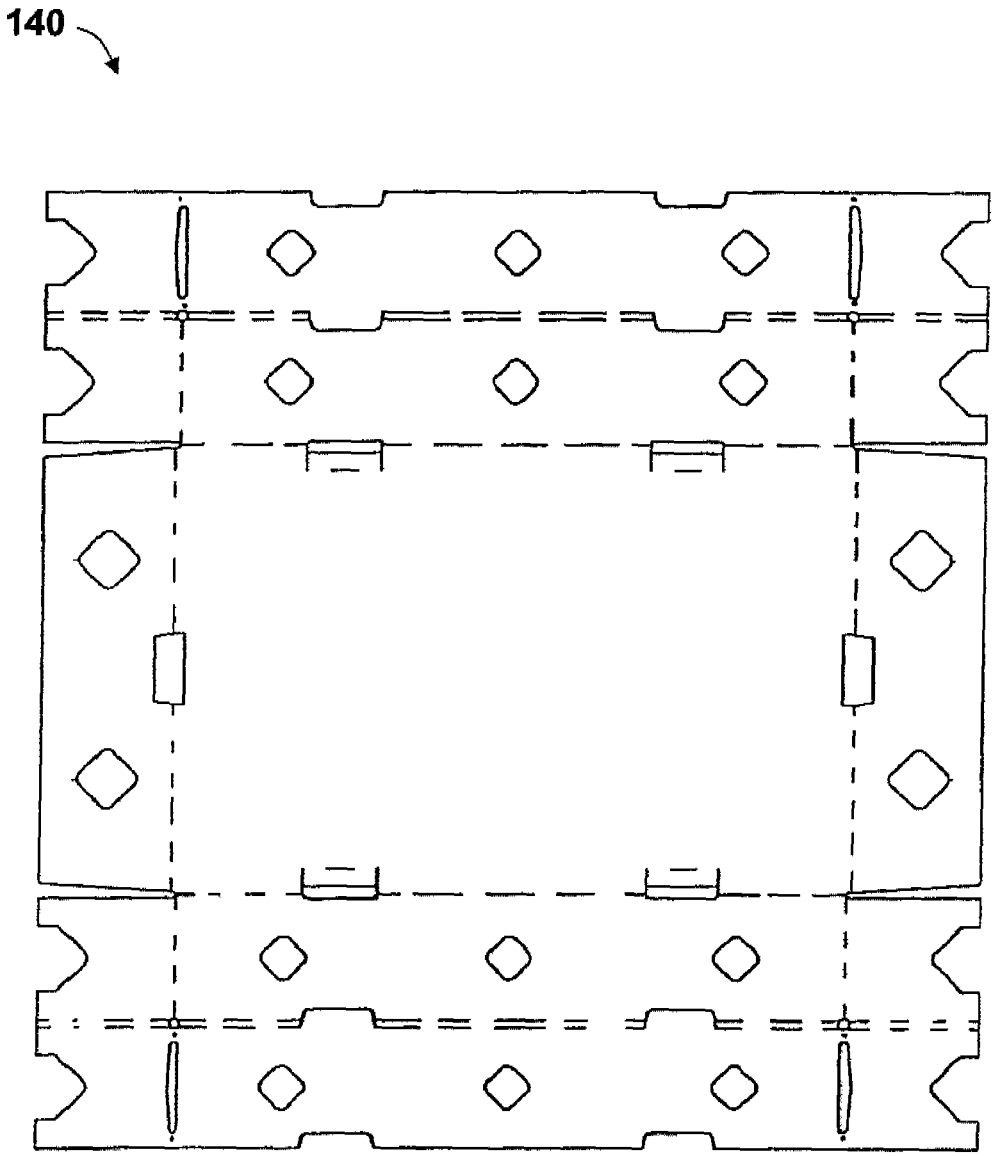
FIG. 14 is a plan view of a blank for a tray according to another embodiment of the invention.

FIG. 14 illustrates a blank 140 that is generally similar to blank 90, except that no corner gusset panels are provided, and is erected in a substantially similar manner to that described for blank 90, except that the first and second minor flaps are connected to one another by double score lines.

Figure 15:
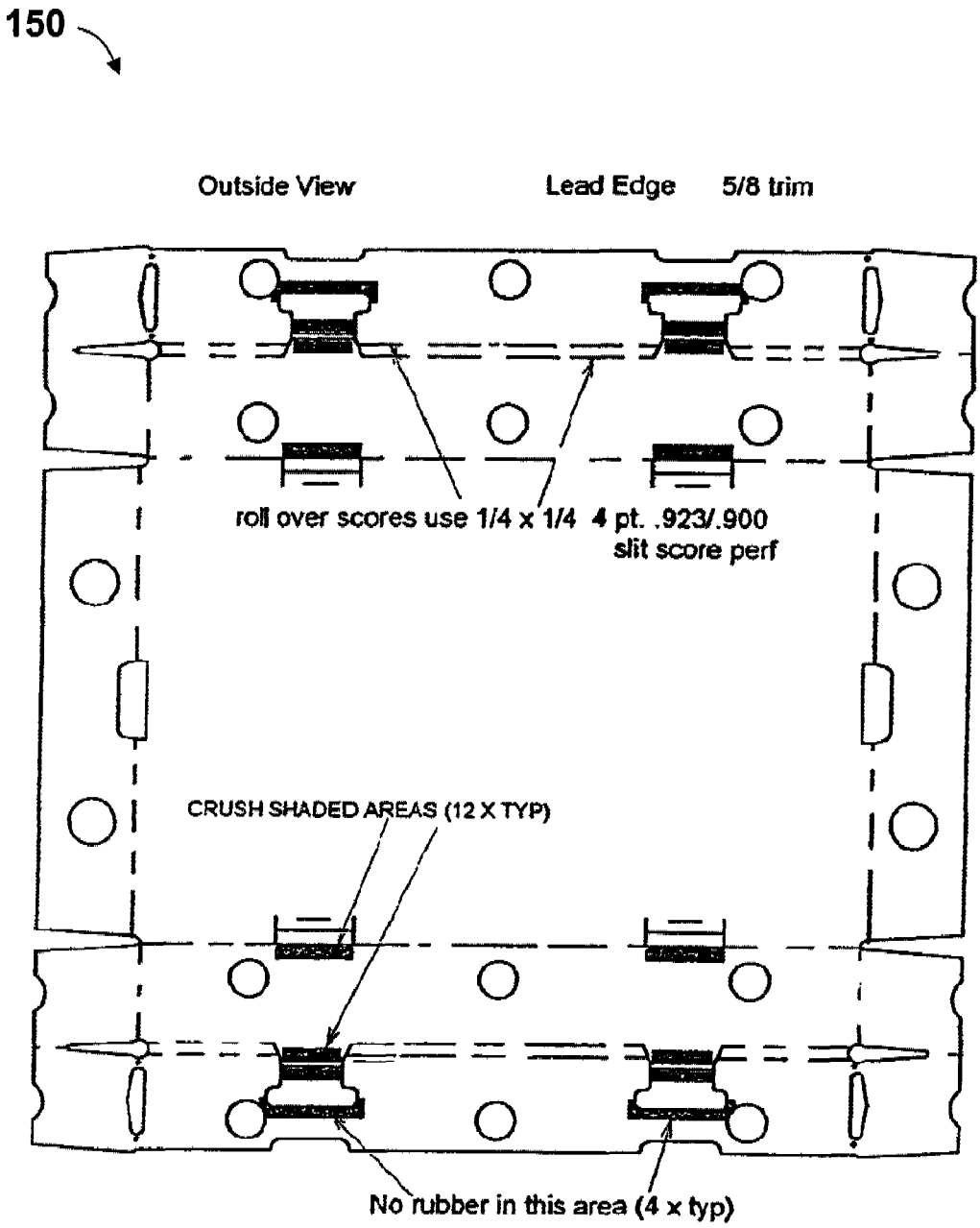
FIG. 15 is a plan view of a blank for a tray according to another embodiment of the invention.

FIG. 15 illustrates a blank 150 that is generally similar to blank 140, and is erected in substantially similar manner, in that the first and second minor flaps are connected to one another by single score lines. The stacking tabs are formed by cutting material from the inner sidewalls, and incorporating fold lines offset from the fold lines separating the inner and outer sidewalls, so that the stacking tabs are exposed, when the inner and outer sidewalls are juxtaposed to one another.

Figure 16:
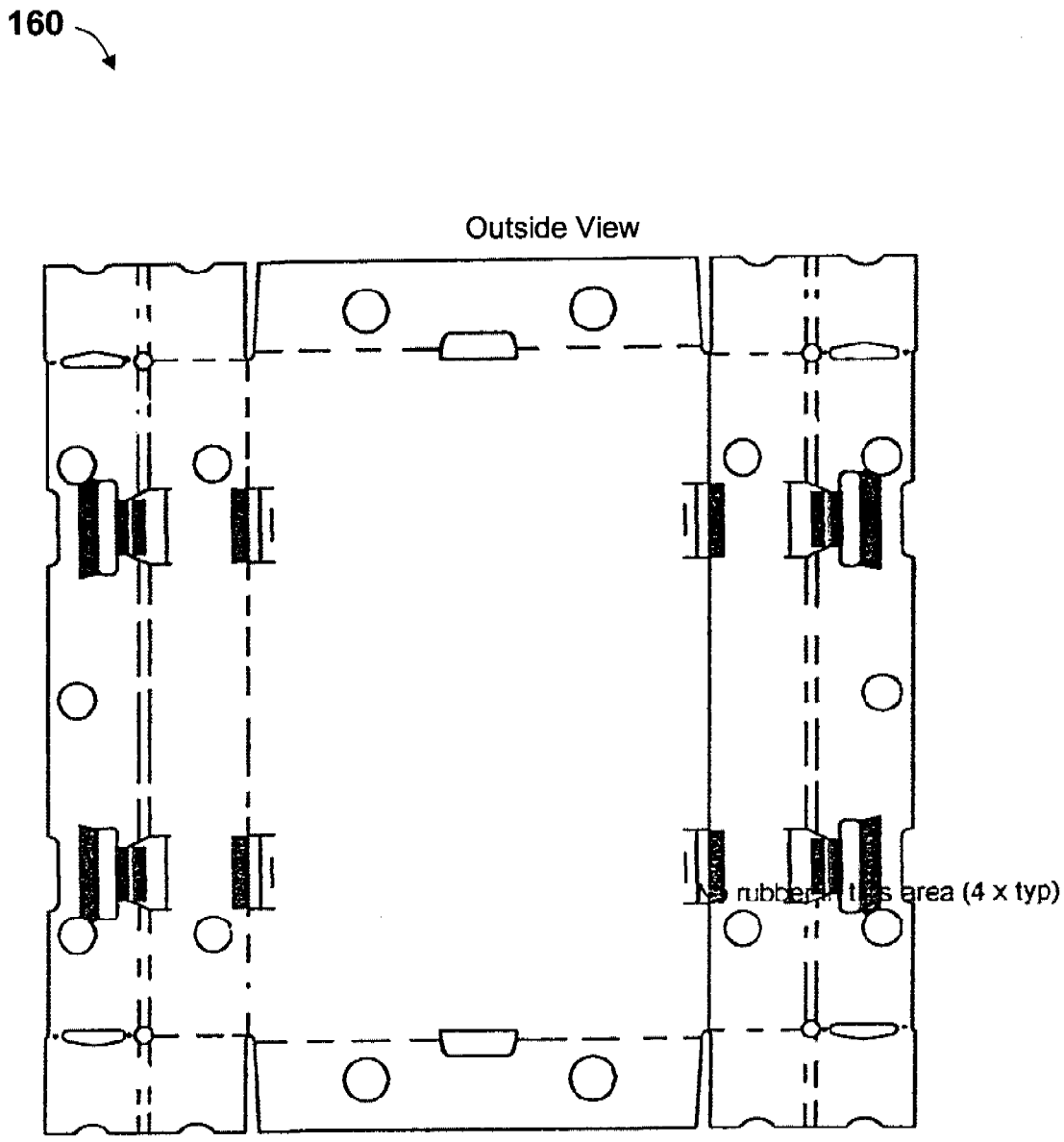
FIG. 16 is a plan view of a blank for a tray according to another embodiment of the invention.
Figure 17:
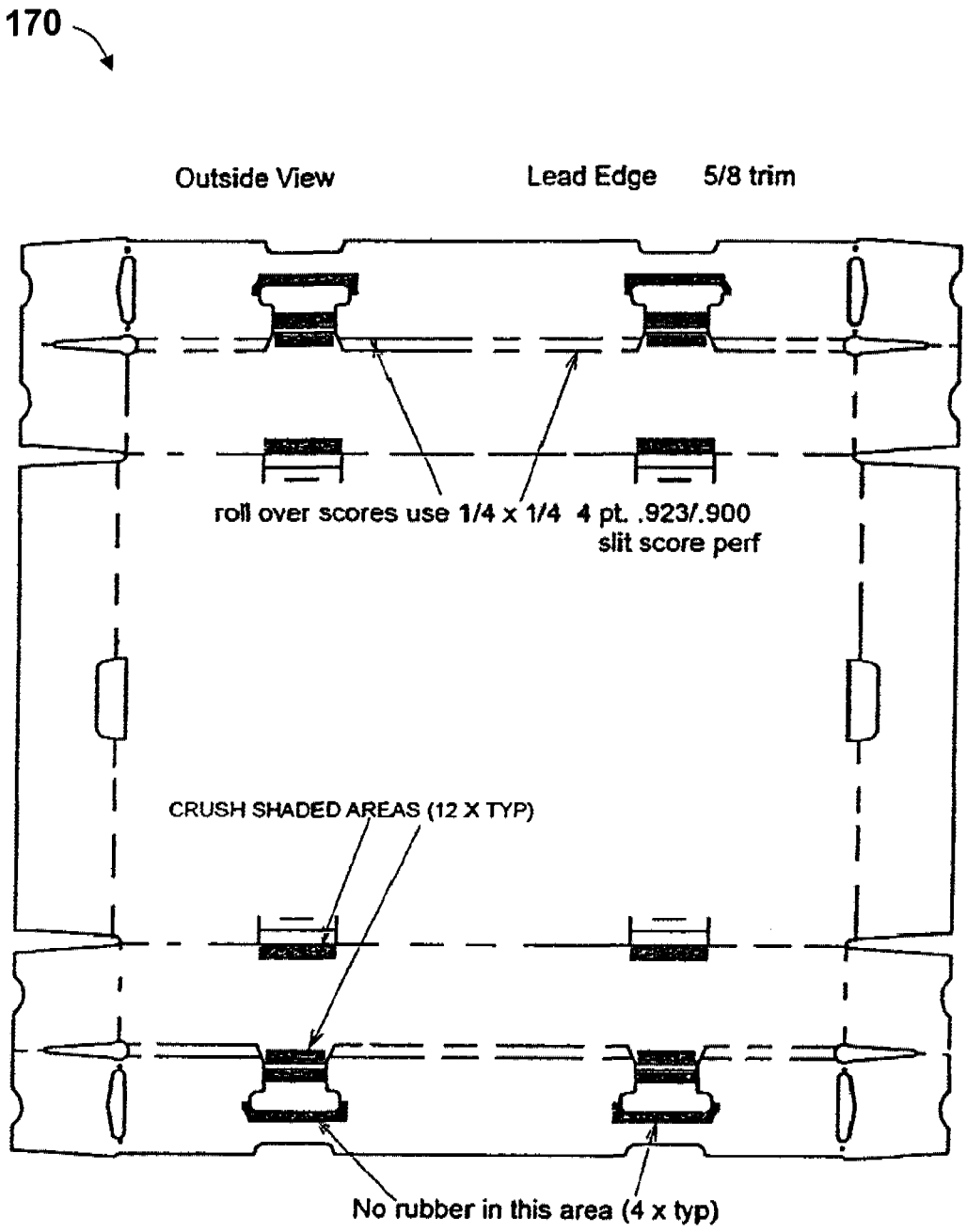
FIG. 17 is a plan view of a blank for a tray according to another embodiment of the invention.
Figure 18:
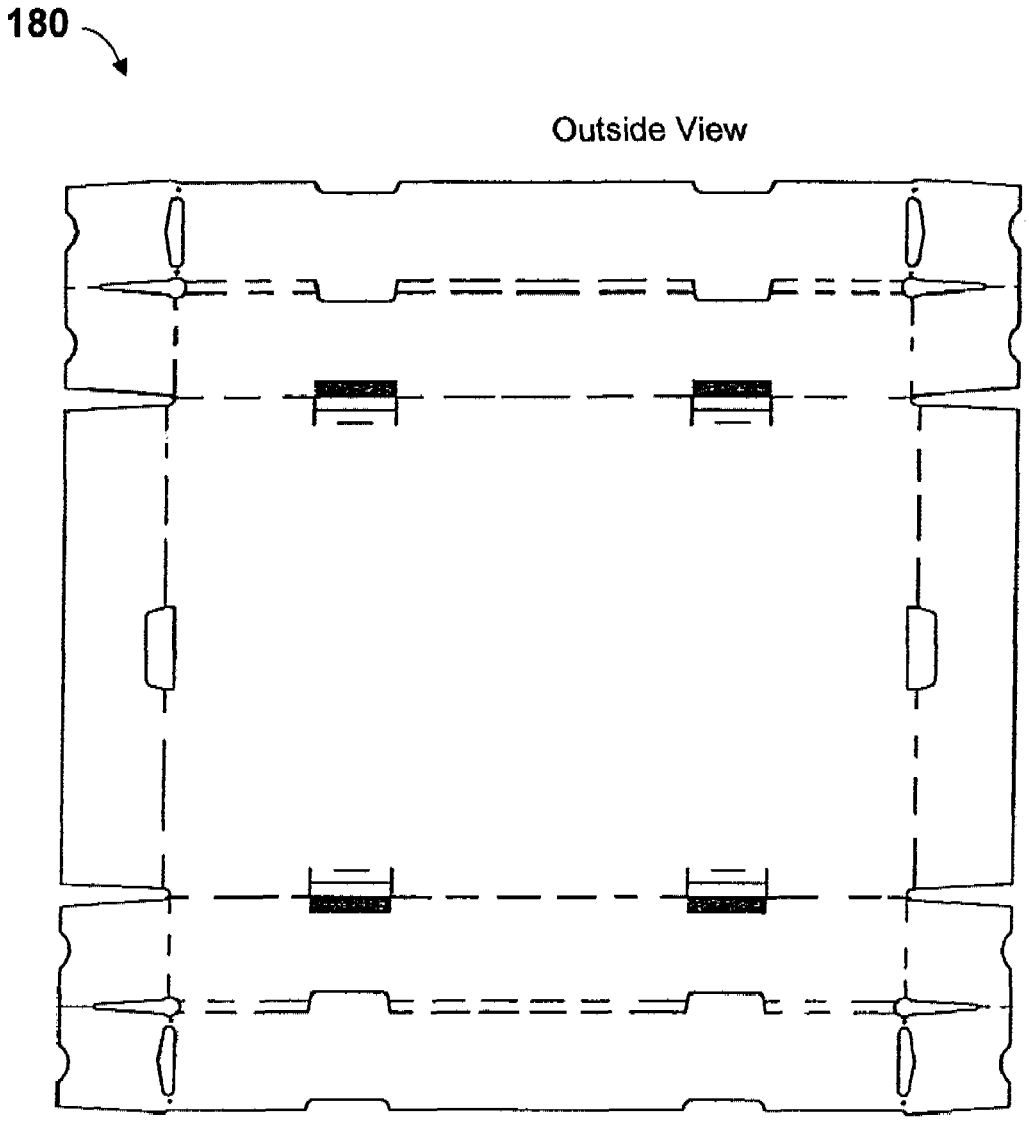
FIG. 18 is a plan view of a blank for a tray according to another embodiment of the invention.
Figure 19:
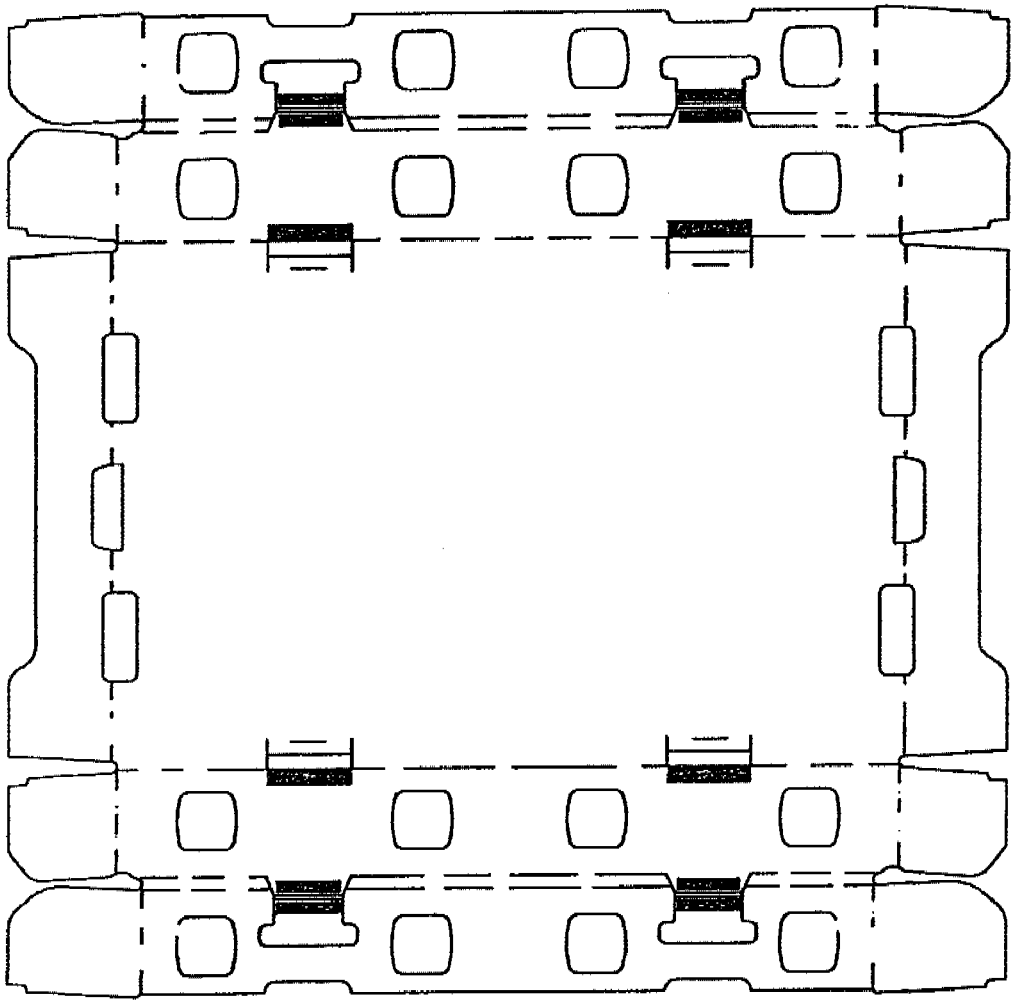
FIG. 19 is a plan view of a blank for a tray according to another embodiment of the invention.

FIG. 16 illustrates a blank 160 that is generally similar in operation and manner of operation as blank 150 of FIG. 15. FIG. 17 illustrates a blank 170 that is also generally similar in form and operation as blank 150 of FIG. 15. FIG. 18 illustrates a blank 180 that is generally similar in form and operation to blank 140 of FIG. 14, except that single fold lines connect the first and second minor flaps. FIG. 19 illustrates a blank 190 that is generally similar in form and operation to blank 90 of FIG. 13, but includes a substantial number of ventilation apertures. Blank 200 of FIG. 20 also includes locking panels that emanate from the top edges of the end walls, which locking panels include sideways extending tabs that are received in slots formed between the inner sidewalls and the second minor flaps, so that blank 200 forms a self-locking tray that does not require adhesive. Blank 210 of FIG. 21 forms a tray having inclined sidewalls, without corner gussets.

Figure 22:
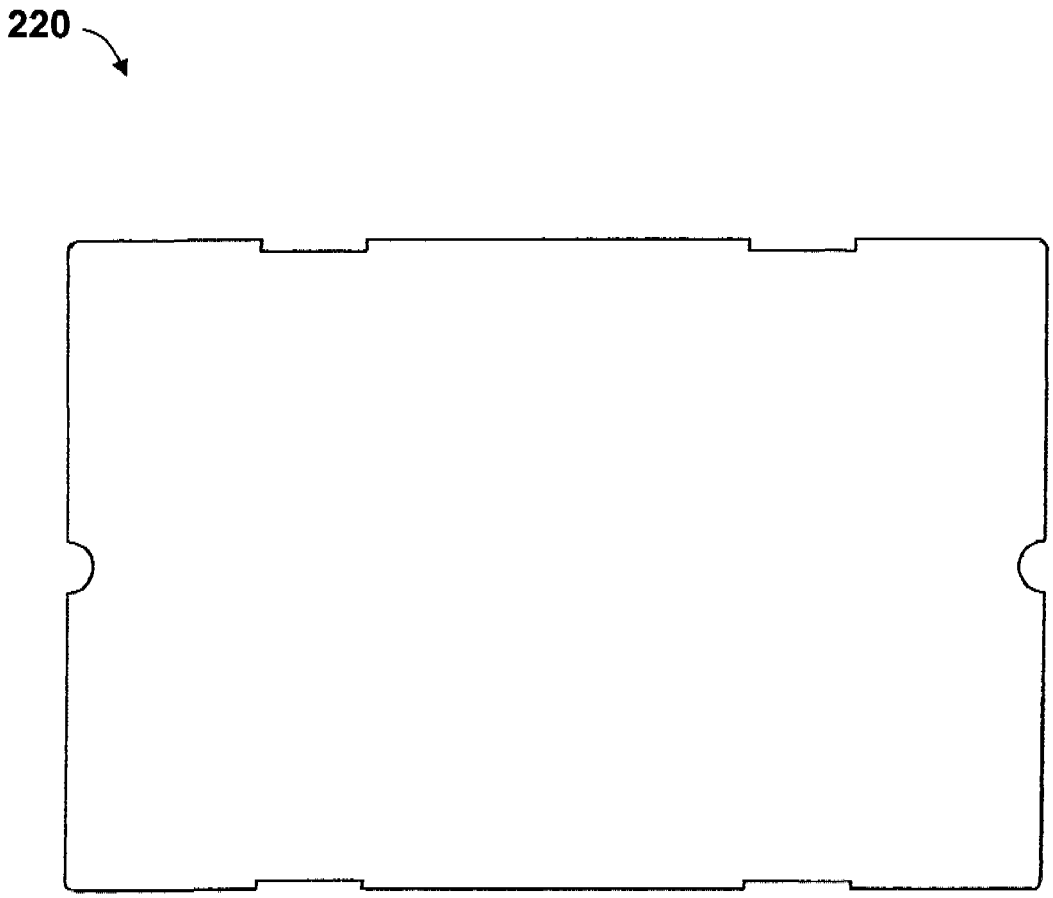
FIG. 22 is a plan view of a blank for forming a die cut pad-type lid, according to one embodiment of the invention.
Figure 23:
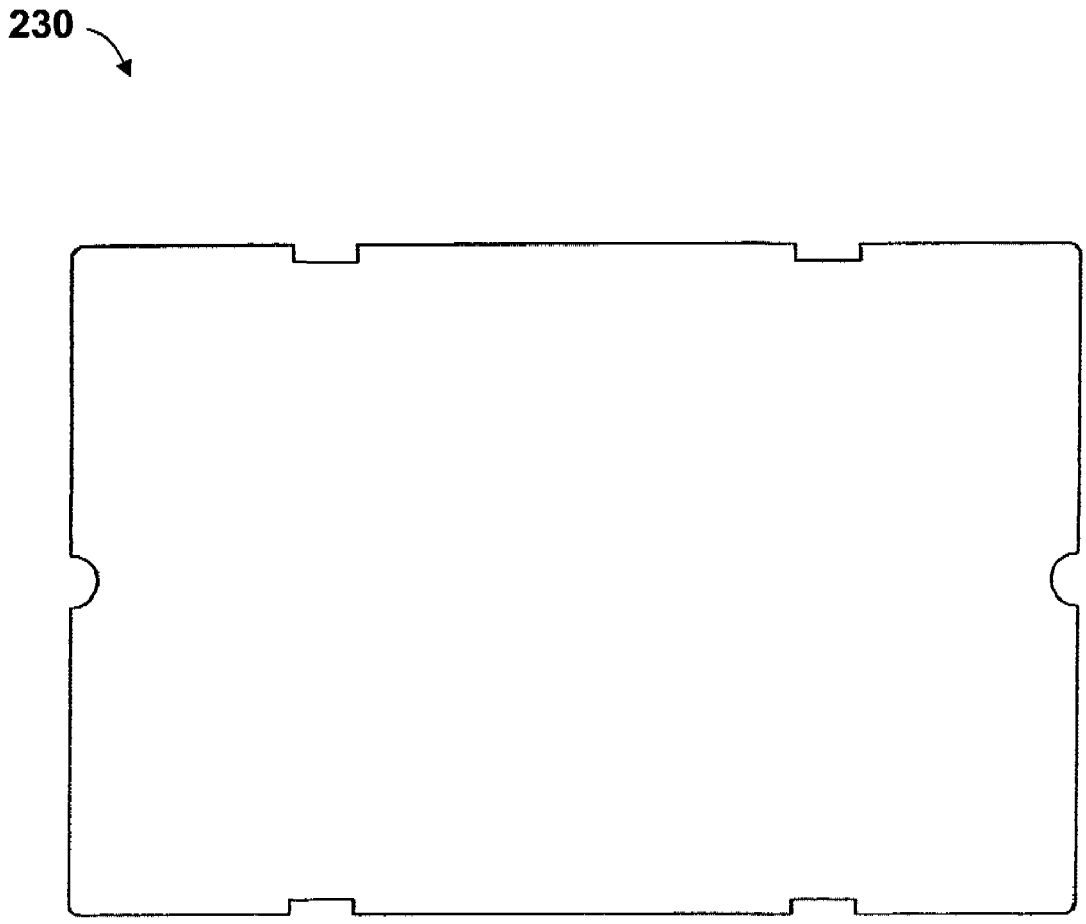
FIG. 23 is a plan view of a blank for forming a die cut pad-type lid, according to one embodiment of the invention.
Figure 24:
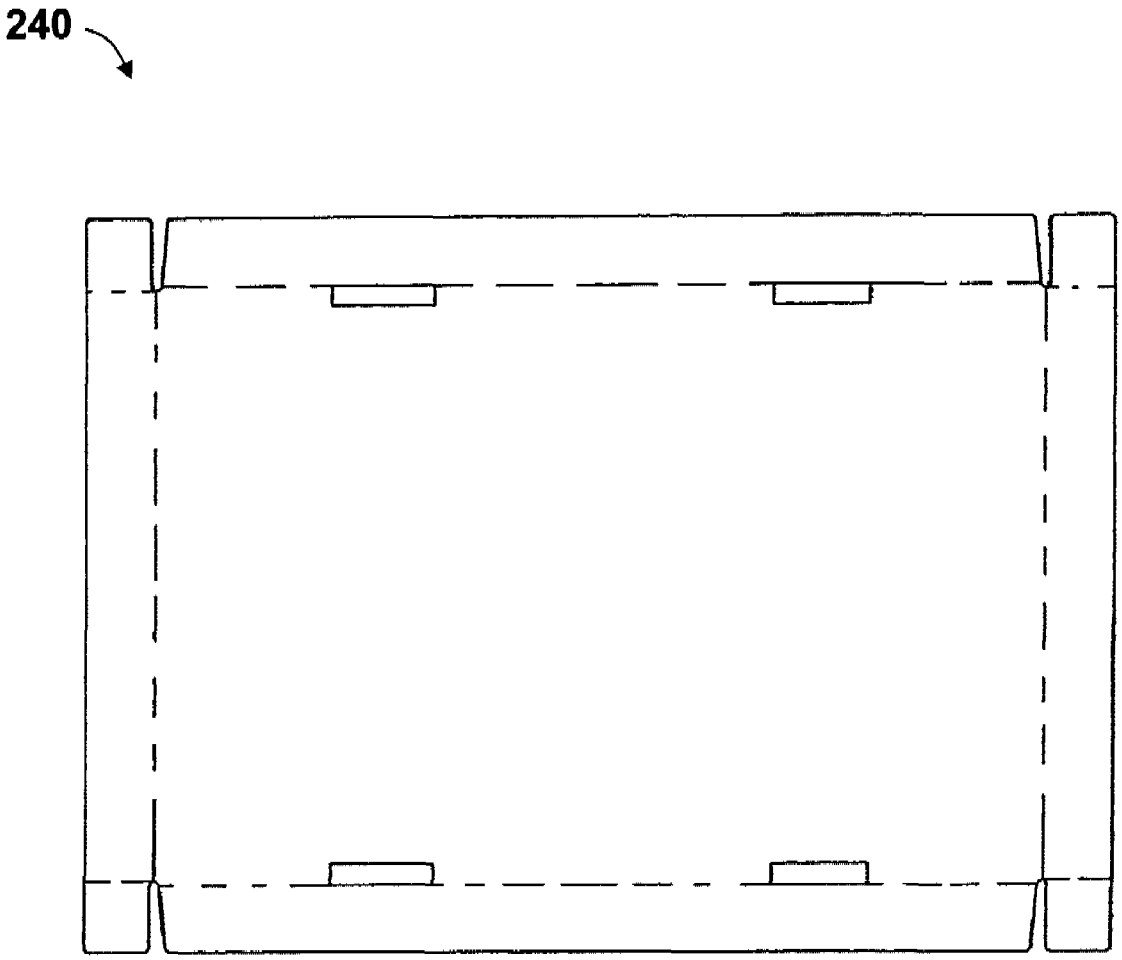
FIG. 24 is a plan view of a blank for forming a shoe box type-lid, according to one embodiment of the invention.
Figure 25:
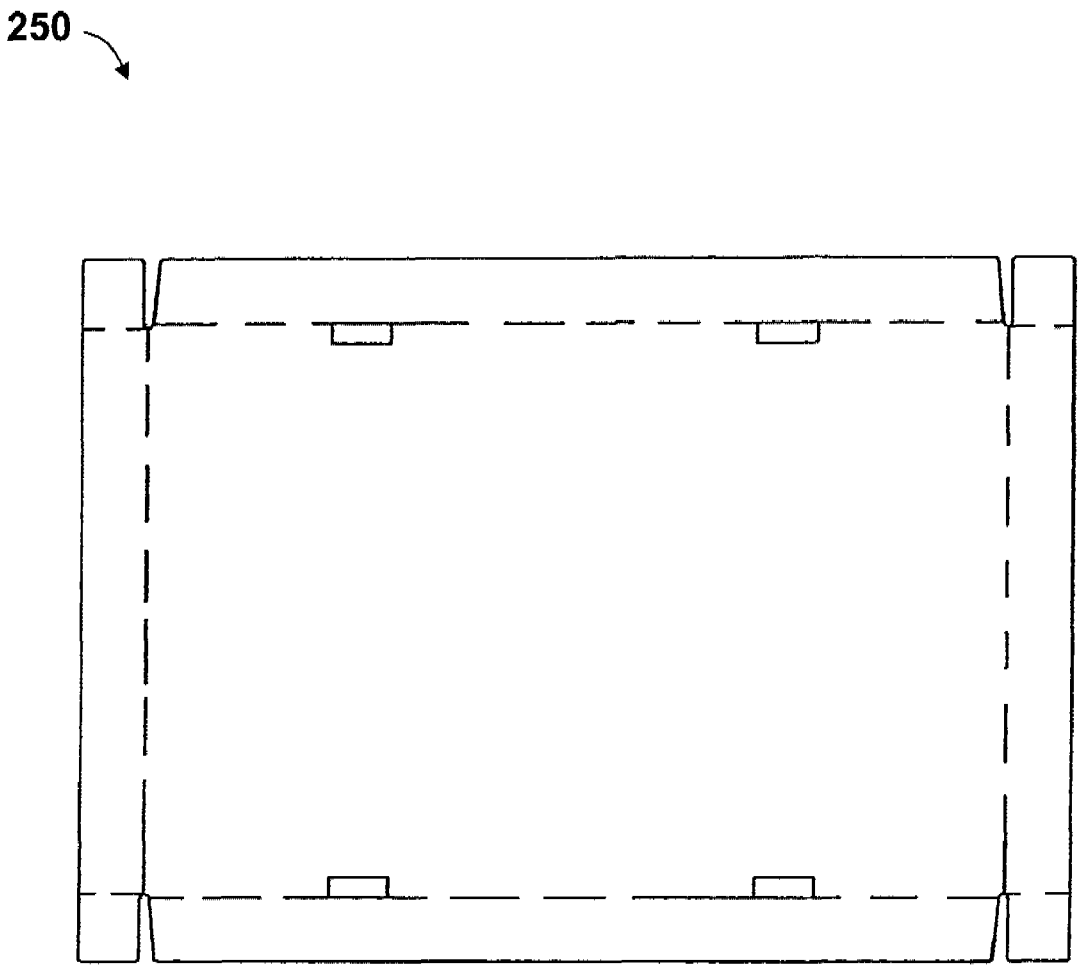
FIG. 25 is a plan view of a blank for forming a shoe box type-lid, according to one embodiment of the invention.

FIGS. 22–23 illustrate blanks 220, 230, respectively, for die cut lids. These blanks are configured to accept stacking tabs, as well as having finger openings on the ends of the blank. FIGS. 24–25 illustrate blanks 240, 250, respectively, for shoe box type lids. These blanks are also configured to accept stacking tabs. The die cut lids and the shoe box type lids may alternatively not have apertures or notches for stacking tabs, if it is known that no stacking tabs will be used in the trays, for which the covers will be provided.

Figure 27:
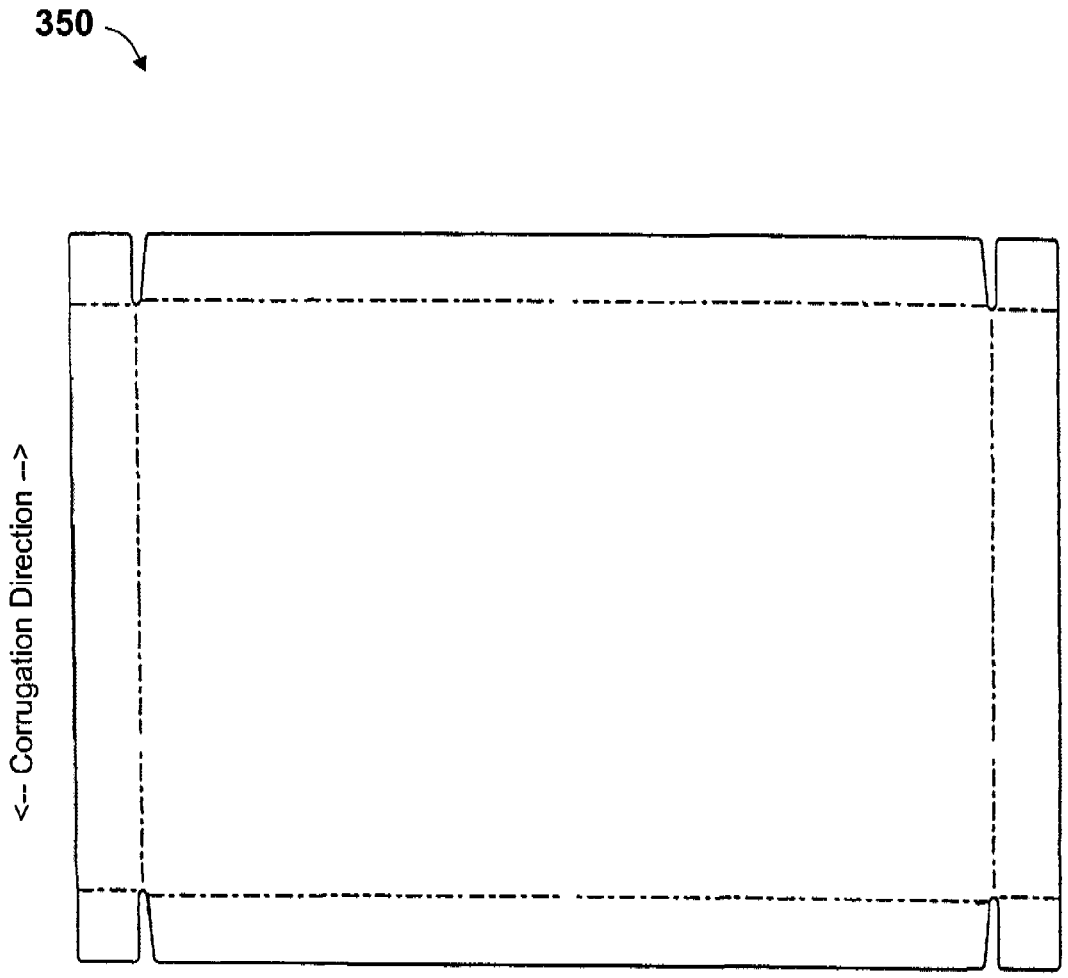
FIG. 27 illustrates a blank for a shoe box type lid for an alternative embodiment of the invention, that is not configured for stacking tabs.
Figure 28:
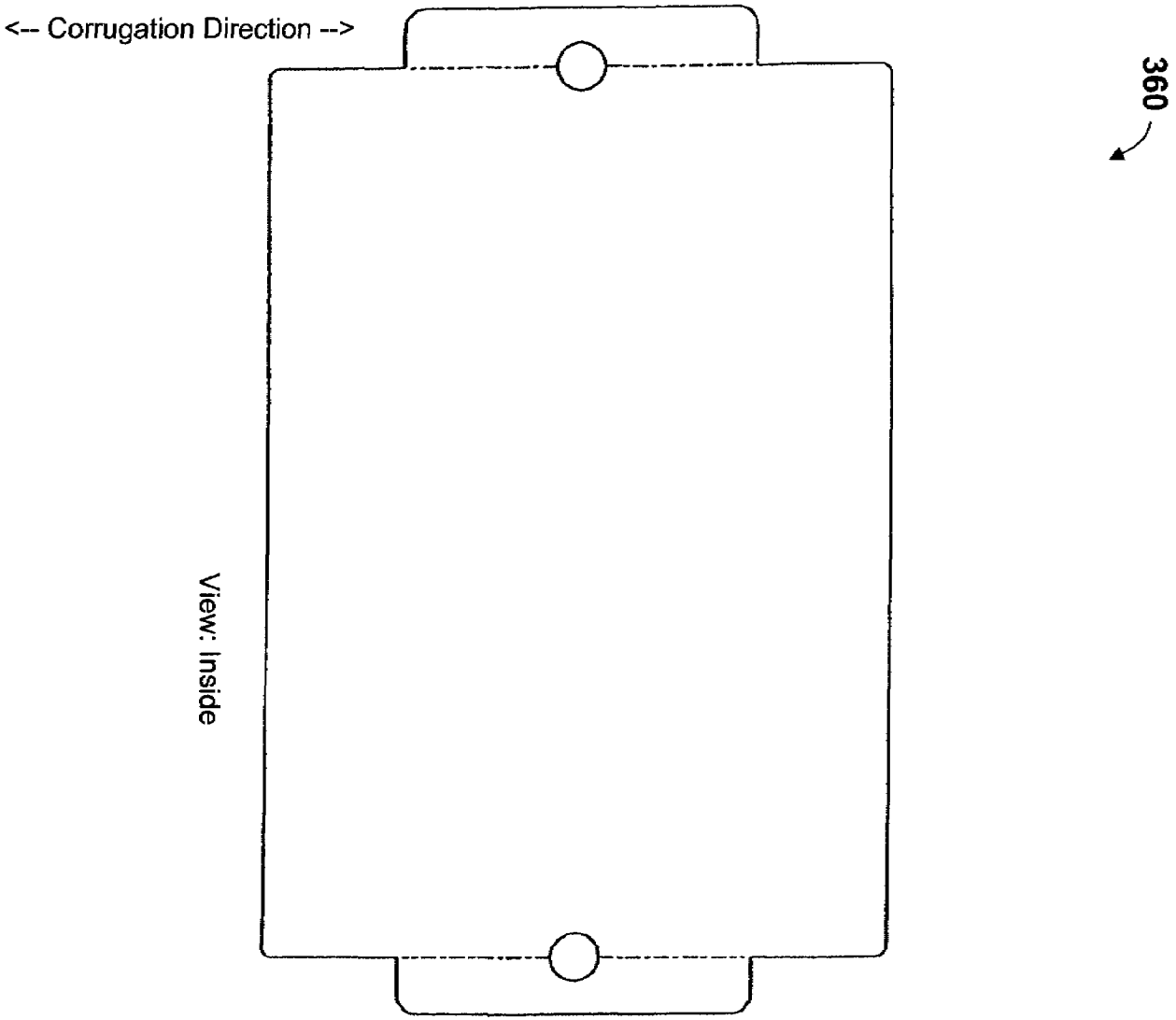
FIG. 28 illustrates a blank for a die cut cover for an alternative embodiment of the invention that is not configured for stacking tabs.
Figure 29:
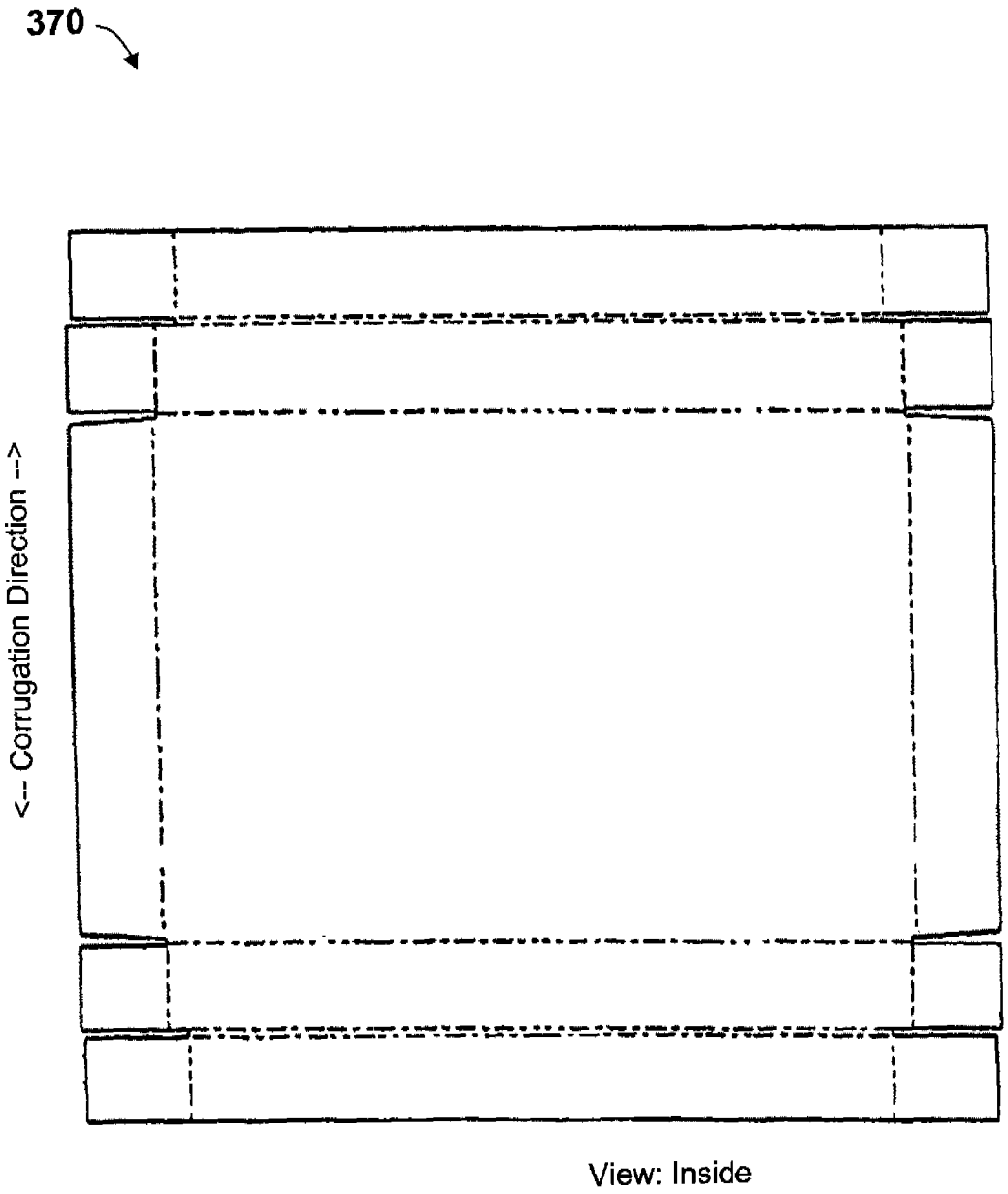
FIG. 29 illustrates a blank for a shoe box type lid for an alternative embodiment of the invention, that is not configured for stacking tabs.

FIG. 27 illustrates a blank 350 for a shoe box type lid, that is not configured for stacking tabs. FIG. 28 illustrates a blank 360 for a die cut cover, that is not configured for stacking tabs, but has downwardly foldable end flaps, to be inserted to the inside of the end walls of the top most tray of a shipping unit. FIG. 29 illustrates a blank 370 for a shoe box type lid, which has double-wall length walls, that is not configured for stacking tabs.

Figure 33:
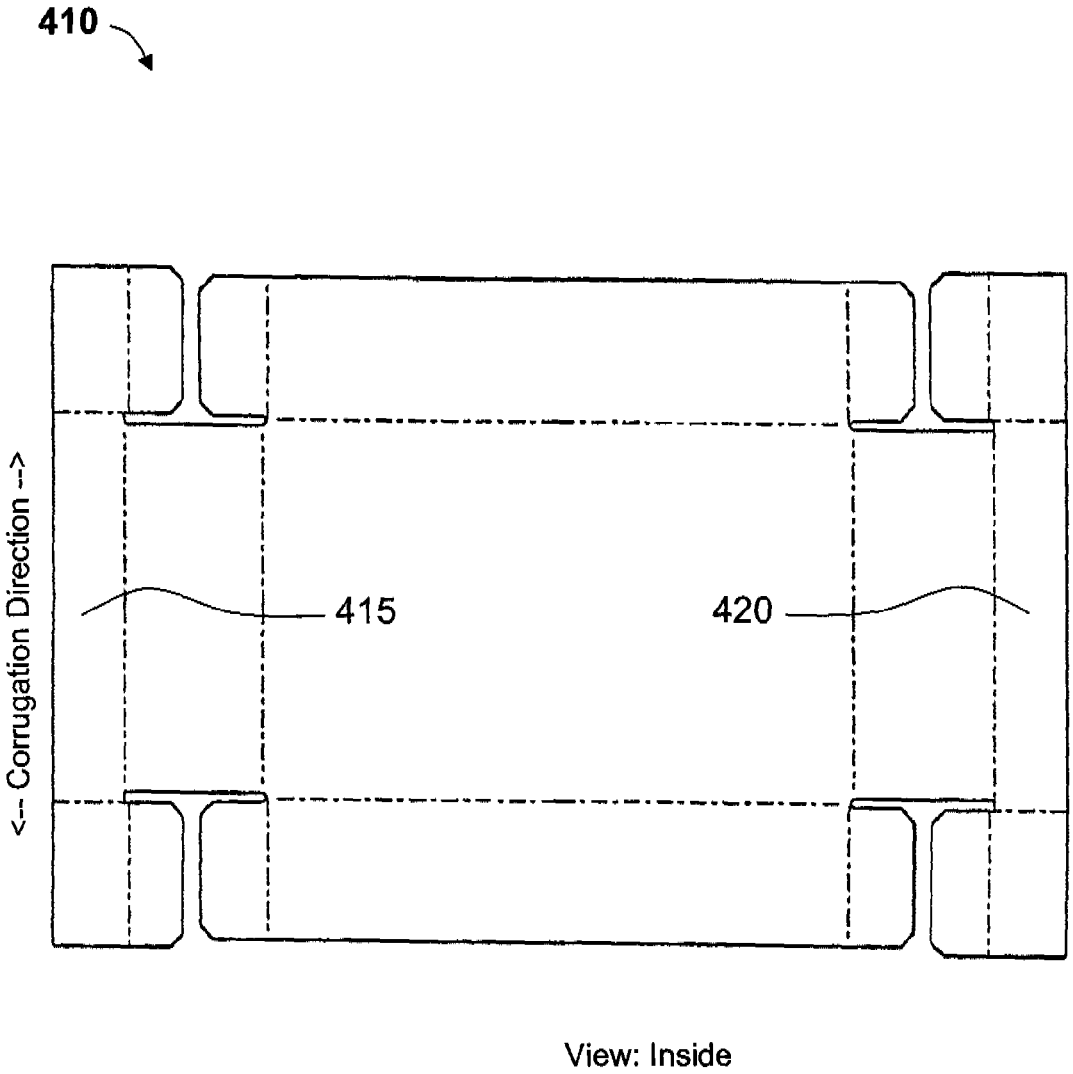
FIG. 33 illustrates a blank for a tray, according to an alternative embodiment of the invention, which results in a tray having stacking shoulders extending across the short ends of the tray.
Figure 34:
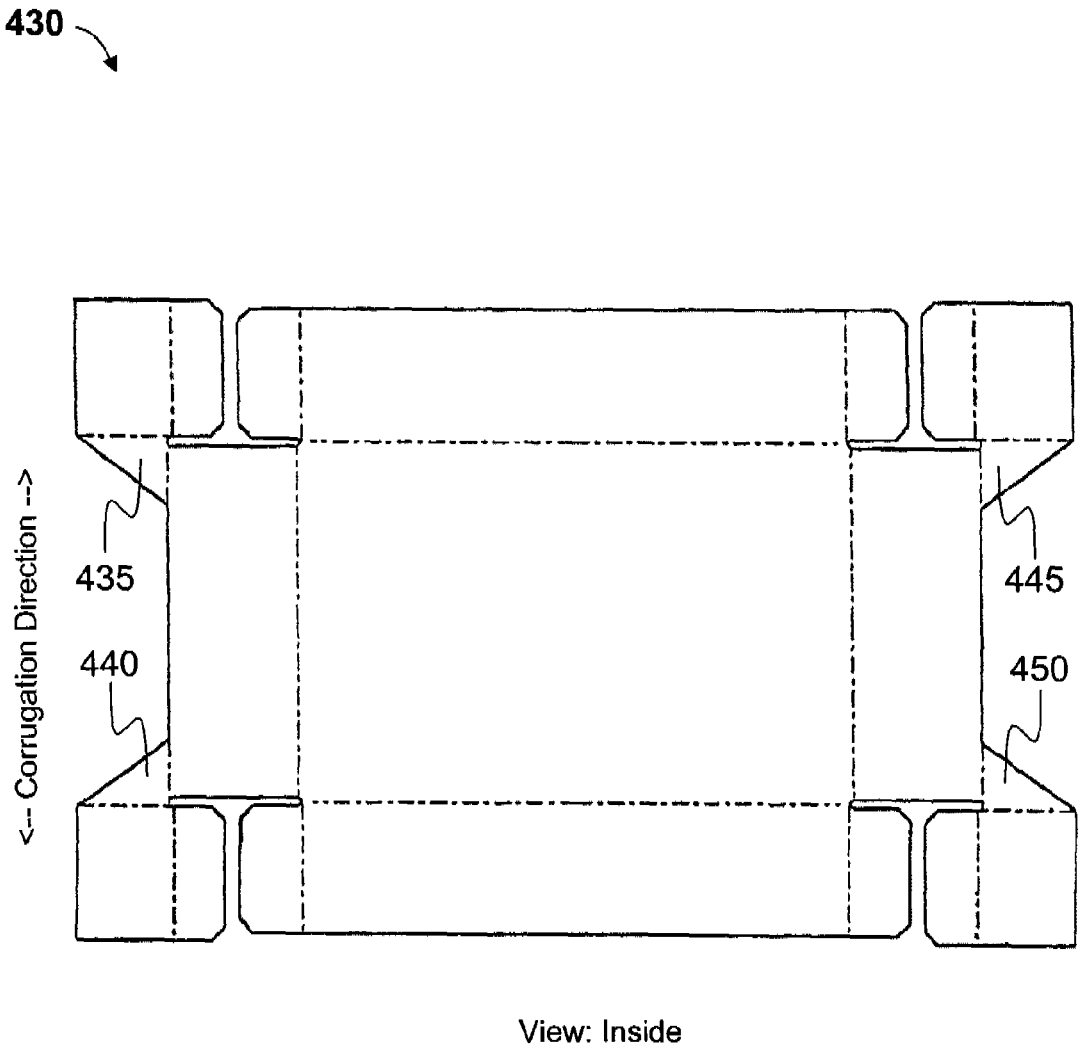
FIG. 34 illustrates a blank for a tray, according to an alternative embodiment of the invention, which results in a tray having stacking shoulders extending diagonally across the corners of the tray.

FIG. 33 illustrates a blank 410 for a tray, according to an alternative embodiment of the invention, which results in a tray having stacking shoulders, formed from panels 415, 420, extending across the short ends of the tray. FIG. 34 illustrates a blank 430 for a tray, according to an alternative embodiment of the invention, which results in a tray having stacking shoulders 435, 440, 445 and 450, extending diagonally across the corners of the tray.

Figure 35:
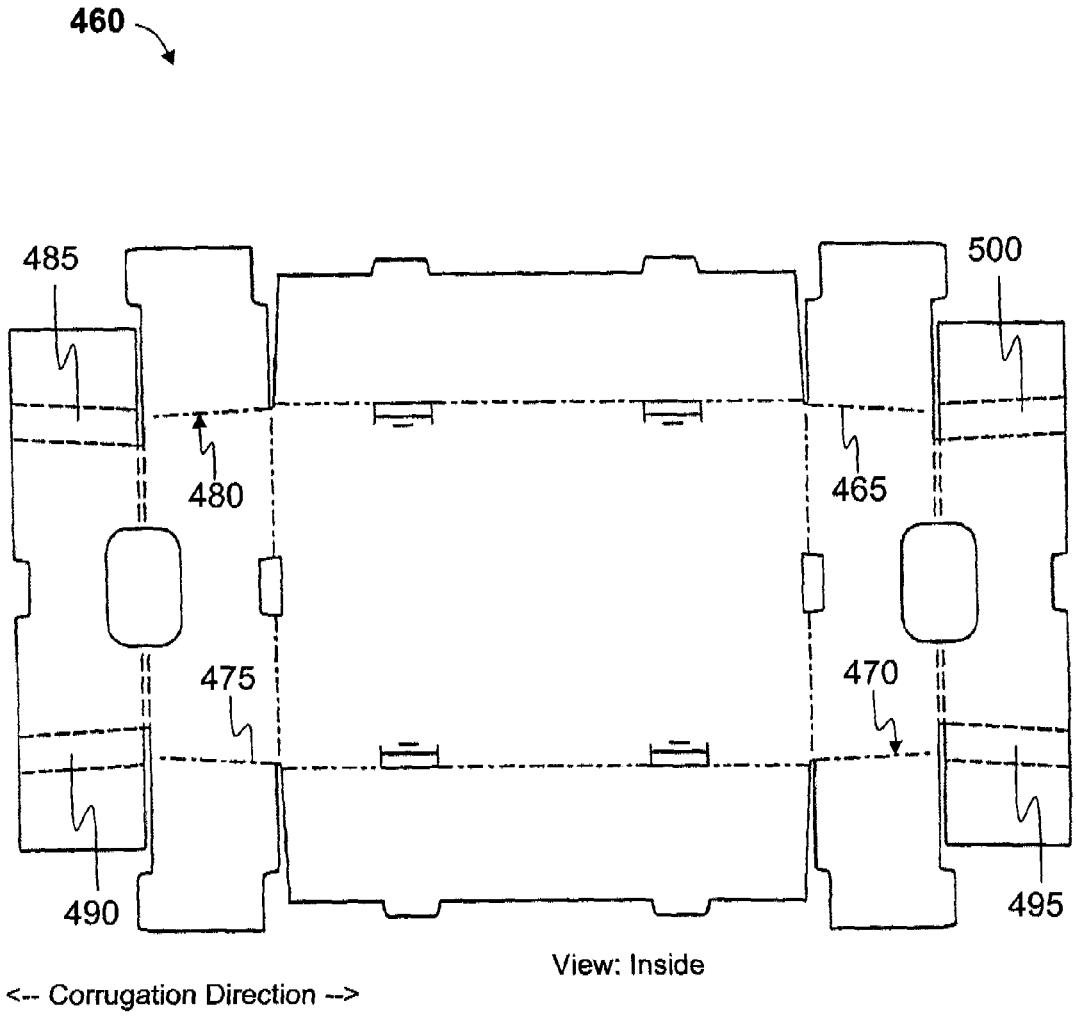
FIG. 35 illustrates a blank for a tray, according to an alternative embodiment of the invention, which results in a tray having inclined side walls, and corner gussets.

FIG. 35 illustrates a blank 460 for a tray, according to an alternative embodiment of the invention, which results in a tray having inclined side walls, due the inclined fold lines 465, 470, 475, 480, between the outer end panels and their respective minor flaps. Blank 460 also produces a tray having corner gussets formed by panels 485, 490, 495 and 500.

Figure 36:
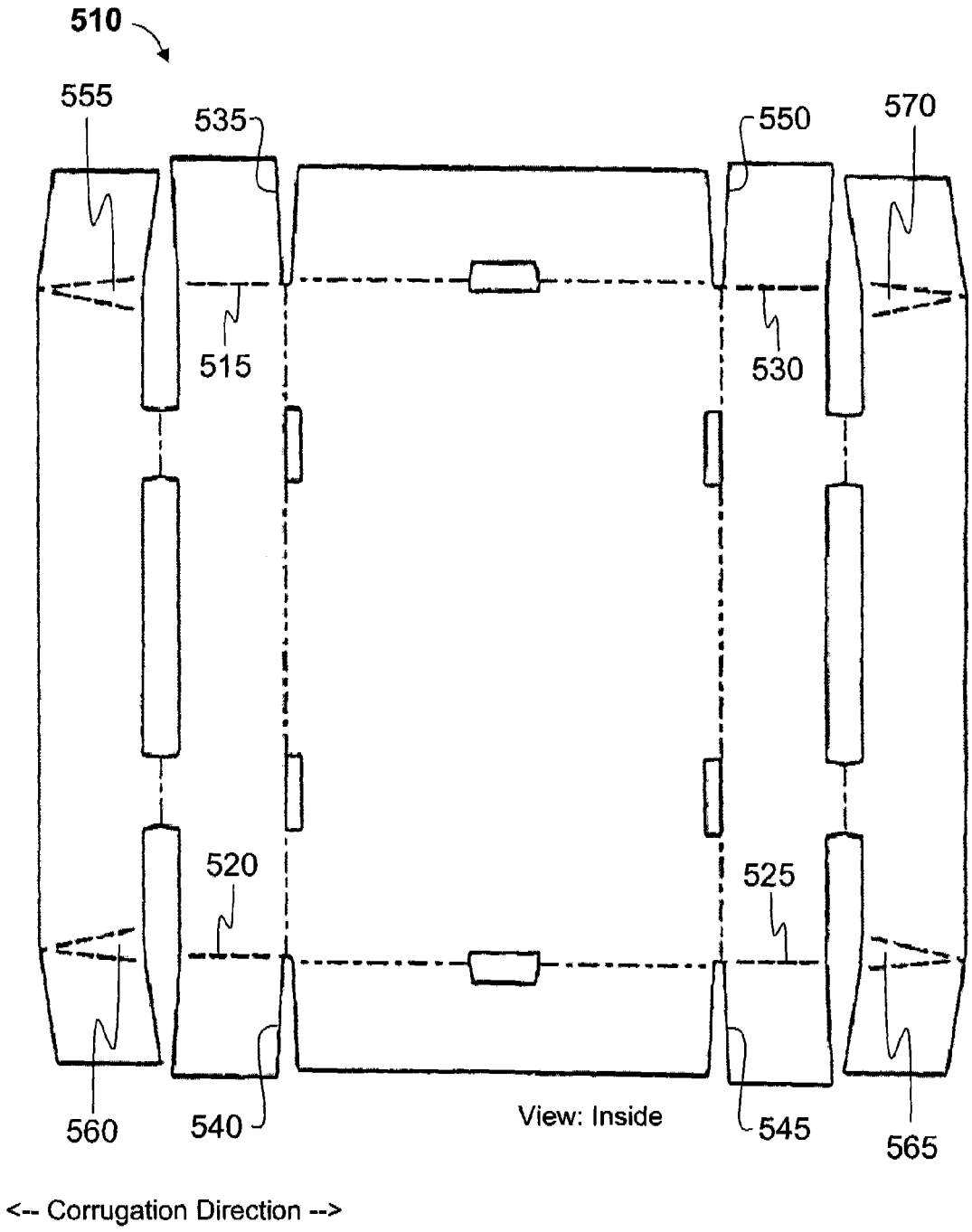
FIG. 36 illustrates a blank for a tray, according to an alternative embodiment of the invention, which results in a tray having inclined side walls and corner gussets.

FIG. 36 illustrates a blank 510 for a tray, according to an alternative embodiment of the invention, which results in a tray having inclined side walls, created by the acute angles between the outer side wall minor flap fold lines 515, 520, 525, 530, and the bottom edges 535, 540, 545, 550 of their respective outer side wall minor flaps. Blank 510 also produces a tray having corner gussets formed by panels 555, 560, 565 and 570.

Figure 37:
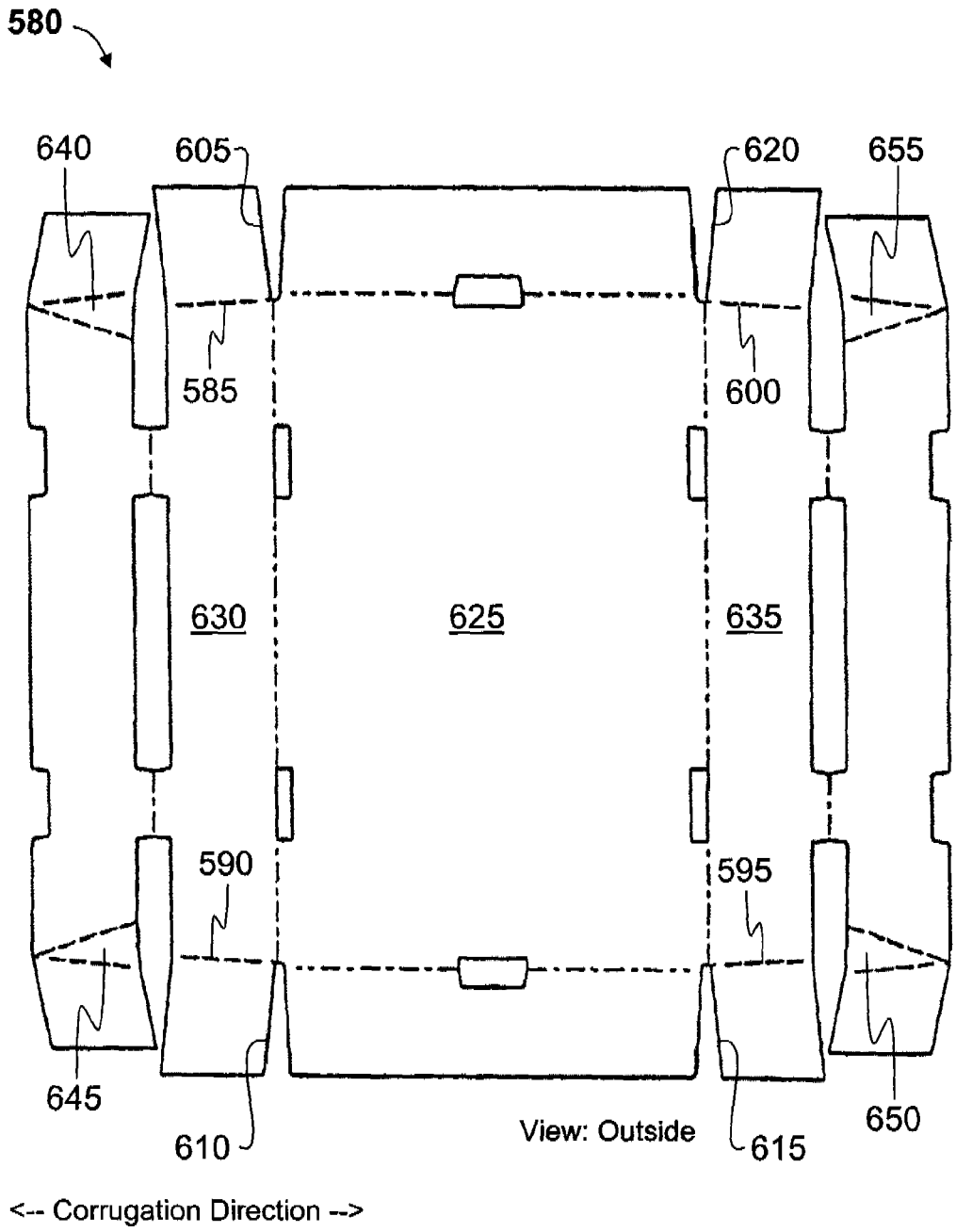
FIG. 37 illustrates a blank for a tray, according to an alternative embodiment of the invention, which results in a tray having inclined side walls and end walls, and corner gussets.

FIG. 37 illustrates a blank 580 for a tray, according to an alternative embodiment of the invention, which results in a tray having inclined side walls, formed by created by the acute angles between the outer side wall minor flap fold lines 585, 590, 595 and 600 and the bottom edges 605, 610, 615, 620 of their respective outer side wall minor flaps. Blank 580 also produces a tray having inclined end walls, created by the acute angles between the outer side wall minor flap fold lines 585, 590, 595 and 600 and the fold lines between the bottom wall 625 and the outer side walls 630, 635. Blank 580 also produces a tray having corner gussets formed by panels 640, 645, 650, 655.

Figure 38:
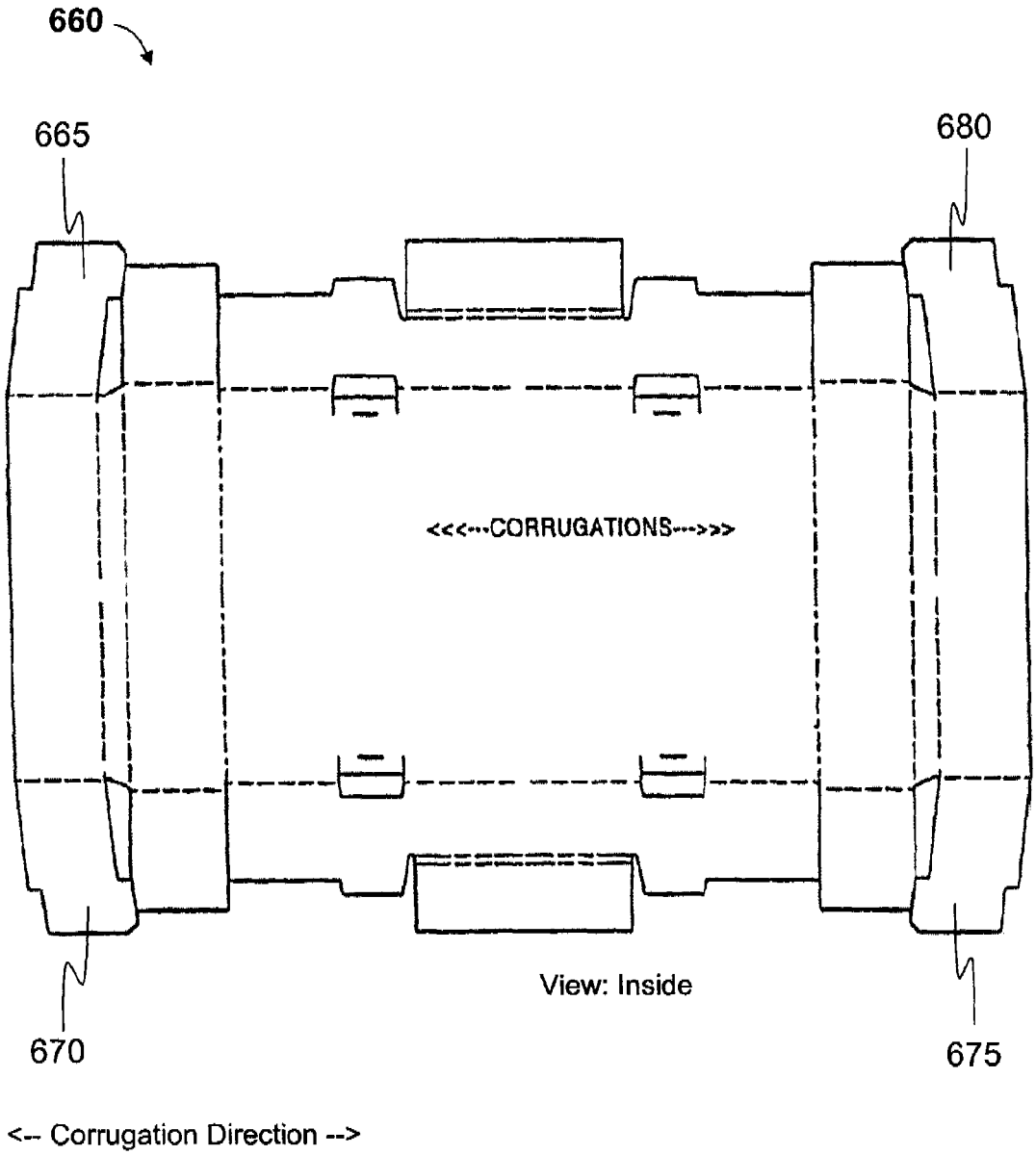
FIG. 38 illustrates a blank for a tray, according to an alternative embodiment of the invention, which results in a tray having a stacking shelf.

FIG. 38 illustrates a blank 660 for a tray, according to an alternative embodiment of the invention, which results in a tray having a stacking shelf created by increasing the width of the bridge between the two vertical end or "depth" panels. In addition, the angled minor flaps 665, 670, 675, 680 coming off the ends of the inner end or "depth" panels, causes the interior volume of the tray to have a truncated pyramidal shape, in that the inside distance at the bases of the end or "depth" panels is greater than the inside distance between the tops of the end or "depth" panels.

Figure 39:
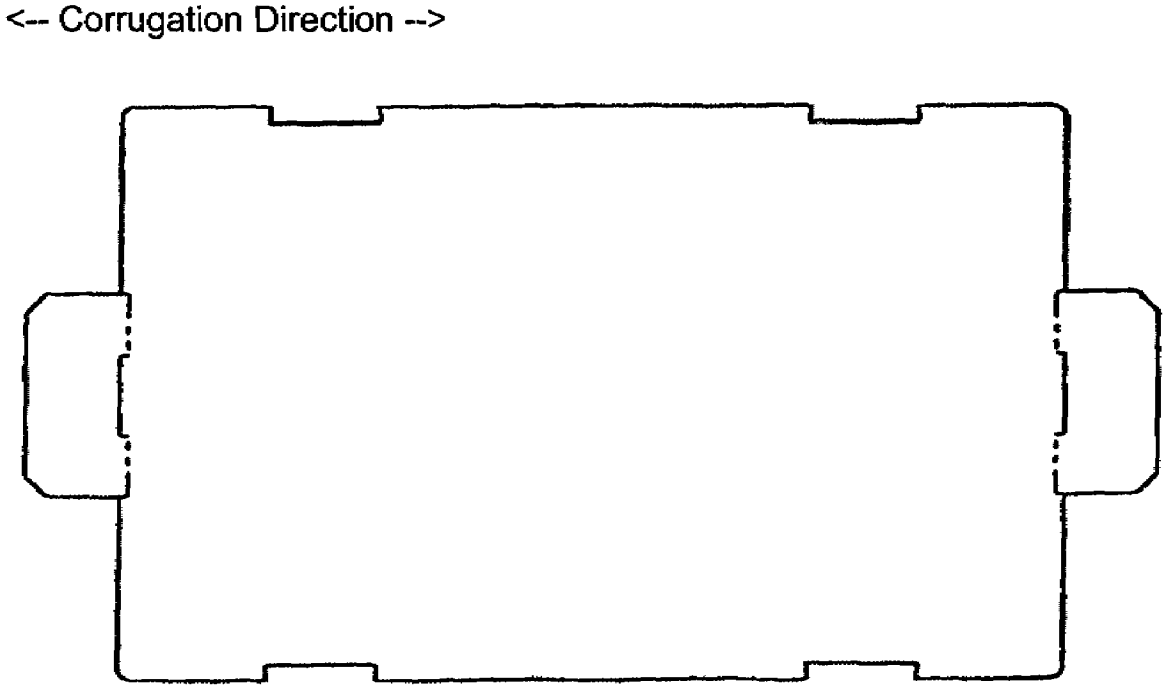
FIG. 39 illustrates a blank for a die cut lid, according to another embodiment of the invention, suitable for use with trays with or without stacking tabs.

FIG. 39 illustrates a blank 690 for a die cut lid, having downwardly foldable end flaps, according to another embodiment of the invention, suitable for use with trays with or without stacking tabs.

Figure 40:
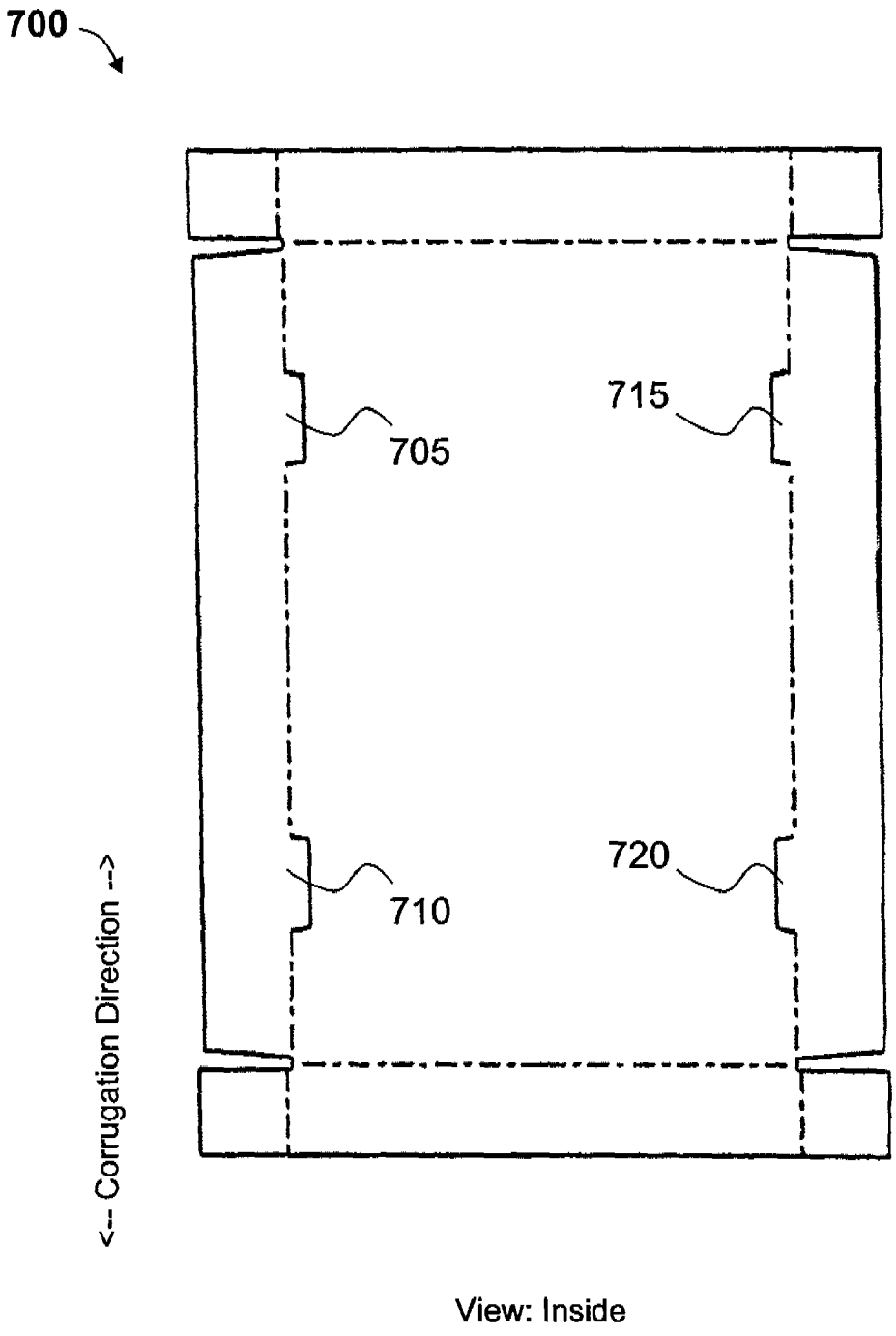
FIG. 40 illustrates a blank for a shoe box type lid, according to another embodiment of the invention, suitable for use with trays with or without stacking tabs.

FIG. 40 illustrates a blank 700 for a shoe box type lid, according to another embodiment of the invention, suitable for use with trays with or without stacking tabs, in which the lid has its own stacking tabs 705, 710, 715, 720.

Figure 41:
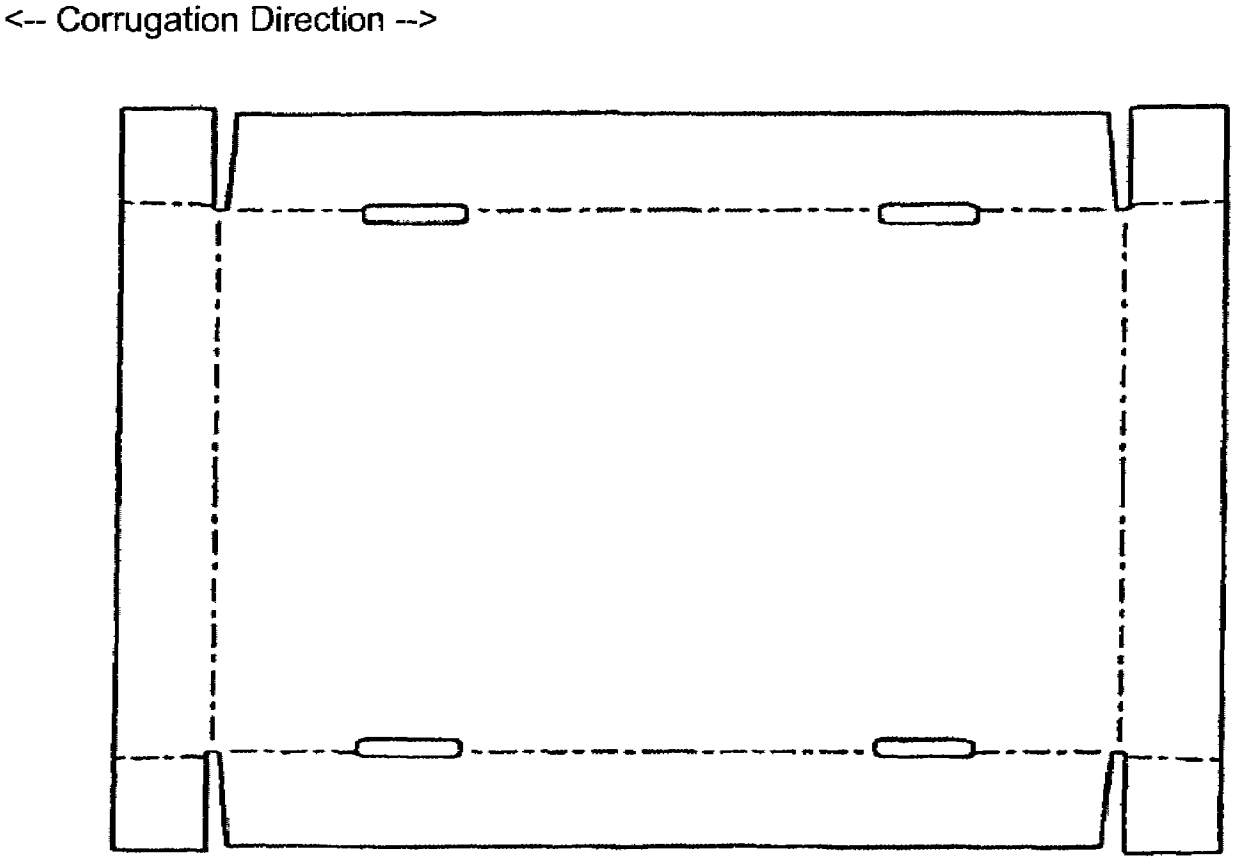
FIG. 41 illustrates a blank for a shoe box type lid, according to another embodiment of the invention, suitable for use with trays with or without stacking tabs.

FIG. 41 illustrates a blank 730 for a shoe box type lid, according to another embodiment of the invention, suitable for use with trays with or without stacking tabs.

In a preferred embodiment of the invention, a complete shipping system is created, when each of the blanks produces a tray having the same "footprint" and locations for the stacking tabs and receiving apertures (if used), with all of the covers (whether pads or shoe box type) having suitably located slots, to receive the stacking tabs from any of the trays, so that a maximum degree of flexibility is attain to the extent that non-identical trays can still be stacked atop one another, covered by a suitable pad or shoe box lid, and banded or strapped as required.

The shipping unit system of the present invention is intended to provide substantial flexibility, in providing for the packing and transportation of items that require a certain degree of separation. This system uses a number of single layer trays to replace the present package designs. Each layer tray carries a single layer of product or primary containers and is capable of providing the necessary stacking strength for each layer of the stack as well as through the unit and the palletized load of collected packages. This provides substantial flexibility as multiple layers of trays, each carrying layers of products can be stacked on top of each other. To enclose the pack, a single cover (die cut pad, tray or scored sheet) is needed to enclose the products in the top tray; as the bottom of each of the lower trays provide the cover for the tray below. To establish specific case pack quantities, stacked layer trays are combined together, with the use of plastic strapping, tape, or a wider band of a variety of materials, that can be either printed or plain, any color, or in the case of plastic film, may be clear, translucent or opaque.

This system has economic advantages through minimizing the number of different, usually exclusive, packaging components found in prior art systems, as well as improving the stacking contribution of the individual components. This system can also permit the reduction of the overall material usage in the package. Furthermore, whereas prior art containers have been limited to manual packaging means, the shipping system of the present invention provides the opportunity to employ automated methods, reducing the labor requirement involved in the packaging process.

The foregoing description and drawings merely explain and illustrate the invention, and the invention is not limited except insofar as the appended claims are so limited, as those skilled in the art who have the disclosure before them will be able to make modifications and variations therein without departing from the scope of the invention.

We claim:

1. A shipping system for the facilitated packing and transportation of items, wherein the items are of a type requiring separation between vertically stacked layers, the shipping system comprising:

at least one shipping unit, each shipping unit further comprising:

at least two substantially open-topped shipping trays, wherein each of said shipping trays is operably configured to be capable of being stacked atop another of the at least two trays, wherein in the stacked configuration each of said shipping trays has at least one shipping tray positioned adjacent thereto such that a pair of adjacently stacked shipping trays includes an upper adjacent substantially open-topped shipping tray and a lower adjacent substantially open-topped shipping tray;

each tray having a top, two opposing side walls and a bottom wall, the bottom wall having a bottom surface, each of the opposing side walls having at least two stacking tabs wherein the stacking tabs of one opposing side wall are substantially aligned with the stacking tabs of the other opposing side wall;

a cover, operably configured to be positioned atop an uppermost one of said at least two substantially open-topped shipping trays of the at least one shipping unit, wherein the bottom wall of each upper adjacent substantially open-topped shipping tray is a lid for each lower adjacent substantially open-topped shipping tray; and at least one binding member, operably configured to hold the cover atop the uppermost substantially open-topped shipping tray of the at least one shipping unit, by extending at least partially across the cover and substantially between the stacking tabs of the uppermost substantially open-topped shipping tray, down the side walls and at least partially across the bottom wall of a plurality of stacked articles, wherein the binding member comprises at least one strip of adhesive material, simultaneously engaging a top surface of the cover and the bottom surface of a bottom-most one of said at least two substantially open-topped shipping trays;

wherein each substantially open-topped shipping tray of said at least two substantially open-topped shipping trays has substantially the same top plan configuration, and the cover has a top plan configuration substantially the same as each of said at least two substantially open-topped shipping trays.

2. The shipping system according to claim 1, wherein at least one substantially open-topped shipping fray of said at least two substantially open-topped shipping trays is fabricated from corrugated paperboard material.

3. The shipping system according to claim 1, wherein at least one cover is fabricated from corrugated paperboard material.

4. The shipping system according to claim 1, wherein the at least two substantially oven-topped shipping trays further include a first shipping tray including stacking tabs and a second shipping tray including apertures for receiving the stacking tabs of the first shipping tray.

5. The shipping system according to claim 1, wherein the cover comprises a substantially planar pad.

6. The shipping system according to claim 5, wherein the pad is configured to accommodate the stacking tabs extending upwardly from an uppermost substantially open-topped tray of the shipping unit.

7. The shipping system according to claim 1, wherein the cover has a shoe box type lid configuration.

8. The shipping system according to claim 7, wherein the shoe box type lid configuration is configured to accommodate the stacking tabs extending upwardly from an uppermost substantially open-topped tray of the shipping unit.

9. The shipping system according to claim 1, wherein the at least one binding member comprises at least one substantially thin, flat band encircling the at least one substantially open-topped tray and the cover.

10. The shipping system according to claim 9, wherein the at least one band is fabricated from paper material.

11. The shipping system according to claim 9, wherein the at least one band is fabricated from plastic material.

12. The shipping system according to claim 9, wherein the at least one band is a metal strap.

13. The shipping system according to claim 1, wherein the shipping unit comprises at least two non-identical substantially open-topped trays, having substantially similar top plan configurations.

14. The shipping system according to claim 1, wherein at least one shipping tray is fabricated from plastic material.

15. The shipping system according to claim 1, wherein at least one cover is fabricated from plastic material.

16. The shipping system according to claim 1, wherein each of said at least two substantially open-topped shipping trays is fabricated from a single piece of corrugated paperboard material.

17. The shipping system according to claim 1, wherein each of said at least two substantially open-topped shipping trays further comprising a front wall, a rear wall and a gusset positioned at each corner of the bottom wall, each gusset extending diagonally connecting at least one of the front wall and the rear wall to at least one of the two opposing side walls.

* * * * *